US011835020B2

(12) United States Patent
Niwa et al.

(10) Patent No.: US 11,835,020 B2
(45) Date of Patent: Dec. 5, 2023

(54) FUEL INJECTION VALVE

(71) Applicant: DENSO CORPORATION, Kariya (JP)

(72) Inventors: Masayuki Niwa, Nisshin (JP); Yosuke Nakagawa, Kariya (JP); Masahiro Okuma, Kariya (JP); Noritsugu Kato, Kariya (JP); Hiroki Kaneta, Kariya (JP)

(73) Assignee: DENSO CORPORATION, Kariya (JP)

( * ) Notice: Subject to any disclaimer, the term of this patent is extended or adjusted under 35 U.S.C. 154(b) by 34 days.

(21) Appl. No.: 17/142,631

(22) Filed: Jan. 6, 2021

(65) Prior Publication Data

US 2021/0123403 A1 Apr. 29, 2021

Related U.S. Application Data

(63) Continuation of application No. PCT/JP2019/019426, filed on May 16, 2019.

(30) Foreign Application Priority Data

Jul. 12, 2018 (JP) ..... 2018-132562

(51) Int. Cl.
*F02M 61/10* (2006.01)

(52) U.S. Cl.
CPC ..... *F02M 61/10* (2013.01)

(58) Field of Classification Search
CPC .... F02M 61/10; F02M 61/18; F02M 61/1873; F02M 61/1886; F02M 61/1833; F02M 61/1806; F02M 61/1846; F02M 61/184
See application file for complete search history.

(56) References Cited

U.S. PATENT DOCUMENTS

| | | | | |
|---|---|---|---|---|
| 2004/0178287 | A1 | 9/2004 | Okamoto et al. | |
| 2005/0023381 | A1 | 2/2005 | Xu | |
| 2006/0049286 | A1 | 3/2006 | Oomura et al. | |
| 2016/0047346 | A1 | 2/2016 | Sugiyama et al. | |
| 2016/0195052 | A1* | 7/2016 | Kaneta | F02M 61/1833 123/299 |
| 2018/0045157 | A1 | 2/2018 | Kaneta | |
| 2018/0073478 | A1* | 3/2018 | Noguchi | F02M 61/162 |

(Continued)

FOREIGN PATENT DOCUMENTS

| | | | | |
|---|---|---|---|---|
| EP | 1128062 | * | 8/2001 | F02M 61/18 |
| FR | 2889258 | * | 2/2007 | F02M 61/10 |
| JP | 2006-2720 | | 1/2006 | |

(Continued)

*Primary Examiner* — Christopher R Dandridge
(74) *Attorney, Agent, or Firm* — Nixon & Vanderhye, PC

(57) ABSTRACT

A nozzle body has an injection hole configured to inject fuel and a fuel passage connecting to the injection hole. A needle is configured to open and close the fuel passage to switch between fuel injection from the injection hole and stop of the fuel injection. An injection hole axis is an imaginary line extending along a center of the injection hole. An injection hole perpendicular cross section is a cross section of the injection hole perpendicular to the injection hole axis. The injection hole perpendicular cross section has a flat shape. The injection hole perpendicular cross section has an area that gradually expands from an inlet of the injection hole to an outlet of the injection hole while maintaining a similar shape.

20 Claims, 19 Drawing Sheets

(56) References Cited

U.S. PATENT DOCUMENTS

2019/0093617 A1 3/2019 Niwa et al.

FOREIGN PATENT DOCUMENTS

| | | | | |
|---|---|---|---|---|
| JP | 2006-283703 | | 10/2006 | |
| JP | 2010-112196 | | 5/2010 | |
| JP | 2013-24087 | | 2/2013 | |
| JP | 2013-87757 | | 5/2013 | |
| JP | 2013-234598 | | 11/2013 | |
| JP | 2014-214626 | | 11/2014 | |
| JP | 2015-209772 | | 11/2015 | |
| JP | WO2016163086 | * | 10/2016 | ..... F02M 61/18 |
| JP | 2017-2876 | | 1/2017 | |
| JP | 2017-025926 | | 2/2017 | |
| JP | 2017-61935 | | 3/2017 | |

* cited by examiner

FUEL INJECTION VALVE

CROSS REFERENCE TO RELATED APPLICATION

The present application is a continuation application of International Patent Application No. PCT/JP2019/019426 filed on May 16, 2019, which designated the U.S. and claims the benefit of priority from Japanese Patent Application No. 2018-132562 filed on Jul. 12, 2018. The entire disclosures of all of the above applications are incorporated herein by reference.

TECHNICAL FIELD

The present disclosure relates to a fuel injection valve that injects fuel.

BACKGROUND

Conventionally, a fuel injection valve is configured to inject fuel. Specifically, a fuel injection valve has a passage to conduct fuel therethrough and an injection hole that is for injecting the fuel.

SUMMARY

A fuel injection valve according to an aspect of the present disclosure includes a nozzle body having an injection hole configured to inject fuel and a fuel passage connecting to the injection hole. The fuel injection valve further includes a needle configured to open and close the fuel passage to switch between fuel injection from the injection hole and stop of the fuel injection. A nozzle axis is an imaginary line extending along the center of the nozzle. An injection hole perpendicular cross section is a cross section of the injection hole perpendicular to the injection hole axis. The injection hole perpendicular cross section has a flat shape.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
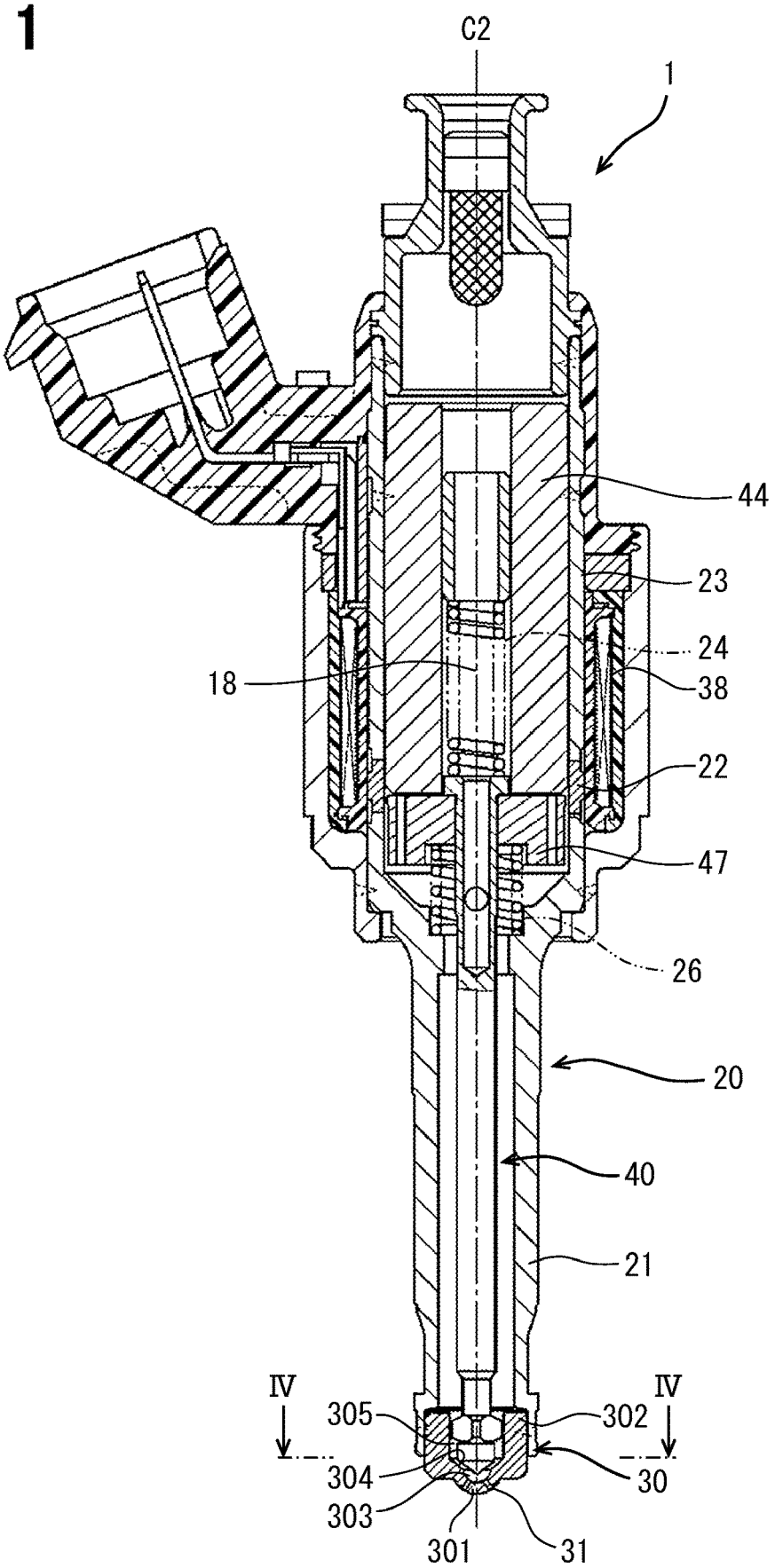
FIG. 1 is a cross-sectional view showing a fuel injection valve according to a first embodiment.

As follows, examples of the present disclosure will be described as follows.

According to an example of the present disclosure, a fuel injection valve has an injection hole that is for injecting fuel and that has a flat shape. An imaginary line extending along the center of the injection hole is referred to as an injection hole axis. In addition, the cross section of the injection hole perpendicular to the injection hole axis is referred to as an injection hole perpendicular cross section. In this case, the perpendicular cross section of the injection hole is formed in a flat shape.

It is noted that fuel flowing through the injection hole does not necessarily flow while entirely filling the perpendicular cross section of the injection hole but flows while partially filling a region of the perpendicular cross section of the injection hole that is along the inner wall surface of the injection hole. That is, the fuel that flows from an inlet of the injection hole further flows through the injection hole while being in a state of a liquid film along the inner wall surface of the injection hole and is injected from an outlet of the injection hole.

Therefore, in a case where the injection hole is formed in a flat shape as described above, thinning of the liquid film is promoted. As a result, the configuration enables to promote atomization of fuel (spray) injected from the outlet and to promote reduction in penetration.

Further, according to an example of the present disclosure, a fuel injection valve has a longitudinal cross section of the injection hole that has a tapered shape in which its area gradually expands from the inlet to the outlet of the injection hole. This configuration also promotes atomization of the spray and reduction in penetration.

However, in the case where the injection hole is formed flat and tapered as described above, the shape of the perpendicular cross section of the injection hole changes in a complicated manner depending on the position of the cross section on the injection hole axis. Therefore, when the injection hole is formed by applying laser processing or drilling on the nozzle body, it may be difficult to machine the shape of the perpendicular cross section of the injection hole into a desired shape depending on the position on the injection hole axis. Therefore, it may be difficult to form the injection hole in a desired shape. Thus, deterioration of accuracy of the shape of the injection hole causes deterioration of accuracy of the shape of the spray.

In particular, the shape of the perpendicular cross section of the injection hole (inlet cross section) at the inlet of the injection hole exerts a great influence on how fuel flows into the injection hole. Therefore, the shape of the perpendicular cross section greatly affects distribution and the shape of the above-mentioned liquid film formed in the injection hole. Thus, the deterioration of the accuracy of the shape of the inlet cross section greatly affects the deterioration of the accuracy of the shape of the spray.

However, in the example as described above, the shape of the perpendicular cross section of the injection hole changes in a complicated manner depending on the position of the cross section on the injection hole axis. Therefore, the shape of the inlet cross section tends to vary due to variation in the plate thickness of the nozzle body and tends to cause deterioration in the accuracy of the spray shape.

A fuel injection valve according to a first aspect of the present disclosure includes a nozzle body having an injection hole configured to inject fuel and a fuel passage connecting to the injection hole. The fuel injection valve further includes a needle configured to open and close the fuel passage to switch between fuel injection from the injection hole and stop of the fuel injection. A nozzle axis is an imaginary line extending along the center of the nozzle. An injection hole perpendicular cross section is a cross section of the injection hole perpendicular to the injection hole axis. The injection hole perpendicular cross section has a flat shape. The injection hole perpendicular cross section has an area that gradually expands from an inlet of the injection hole to an outlet of the injection hole while maintaining an analogue shape.

According to the first aspect, the injection hole perpendicular cross section has a flat shape. The injection hole perpendicular cross section has an area that gradually expands from the inlet of the injection hole to the outlet of the injection hole while maintaining a similar shape. Therefore, the shapes of the injection hole perpendicular cross sections are analogous regardless of the positions of the cross sections on the injection hole axis. Therefore, compared to an assumable configuration in which the shape of the injection hole perpendicular cross section changes according to the position on the injection hole axis in a complicated manner, the configuration of the aspect enables to facilitate machining of the shape of the injection hole perpendicular cross section according to the position on the injection hole axis into a desired shape. Therefore, the configuration enables to form the injection hole to have an oblate shape and to have a shape in which the area gradually expands while suppressing deterioration of the accuracy of the spray shape due to deterioration of the accuracy of the injection hole shape.

In particular, the configuration of the nozzle body having the similar shape as described above enables to suppress a variation in the shape of the injection hole perpendicular cross section (inlet cross section) at the injection hole inlet caused by variation in the plate thickness of the nozzle body. Therefore, the configuration enables to suppress deterioration of the accuracy of the spray shape effectively.

A fuel injection valve according to a second aspect of the present disclosure includes a nozzle body having an injection hole configured to inject fuel and a fuel passage connecting to the injection hole. The fuel injection valve includes a needle configured to open and close the fuel passage to switch between fuel injection from the injection hole and stop of the fuel injection. A nozzle axis is an imaginary line extending along the center of the nozzle. An injection hole perpendicular cross section is a cross section of the injection hole perpendicular to the injection hole axis. The injection hole perpendicular cross section has a shape in which an area gradually expands from the inlet to the outlet while maintaining an elliptical shape having a short axis and a long axis. That is, the injection hole has a shape in which the ratio of the length of the short axis to the length of the long axis does not change from the inlet to the outlet.

Further, the injection hole perpendicular cross section has a shape that is an elliptical shape and that gradually expands in area from the inlet to the outlet. The injection hole has a shape in which the ratio of the length of the short axis to the length of the long axis does not change from the inlet to the outlet. Therefore, compared to an example of a configuration in which the shape of the injection hole perpendicular cross section changes according to the position on the injection hole axis in a complicated manner, the configuration enables to facilitate machining of the shape of the injection hole perpendicular cross section according to the position on the injection hole axis into a desired shape. Therefore, the configuration enables to form the injection hole to have an elliptical shape and to have a shape in which the area gradually expands while suppressing deterioration of the accuracy of the spray shape due to deterioration of the accuracy of the injection hole shape.

In particular, the configuration of the nozzle body in which the ratio of the short axis/the long axis does not change as described above enables to suppress a variation in the shape of the injection hole perpendicular cross section (inlet cross section) at the injection hole inlet caused by variation in the plate thickness of the nozzle body. Therefore, the configuration enables to suppress deterioration of the accuracy of the spray shape effectively.

Hereinafter, multiple embodiments of the present disclosure will be described with reference to the drawings. The same reference numerals are assigned to the corresponding components in each embodiment, and thus, duplicate descriptions may be omitted. When only a part of the configuration is described in the respective embodiments, the configuration of the other embodiments described before may be applied to other parts of the configuration.

First Embodiment

Figure 2:
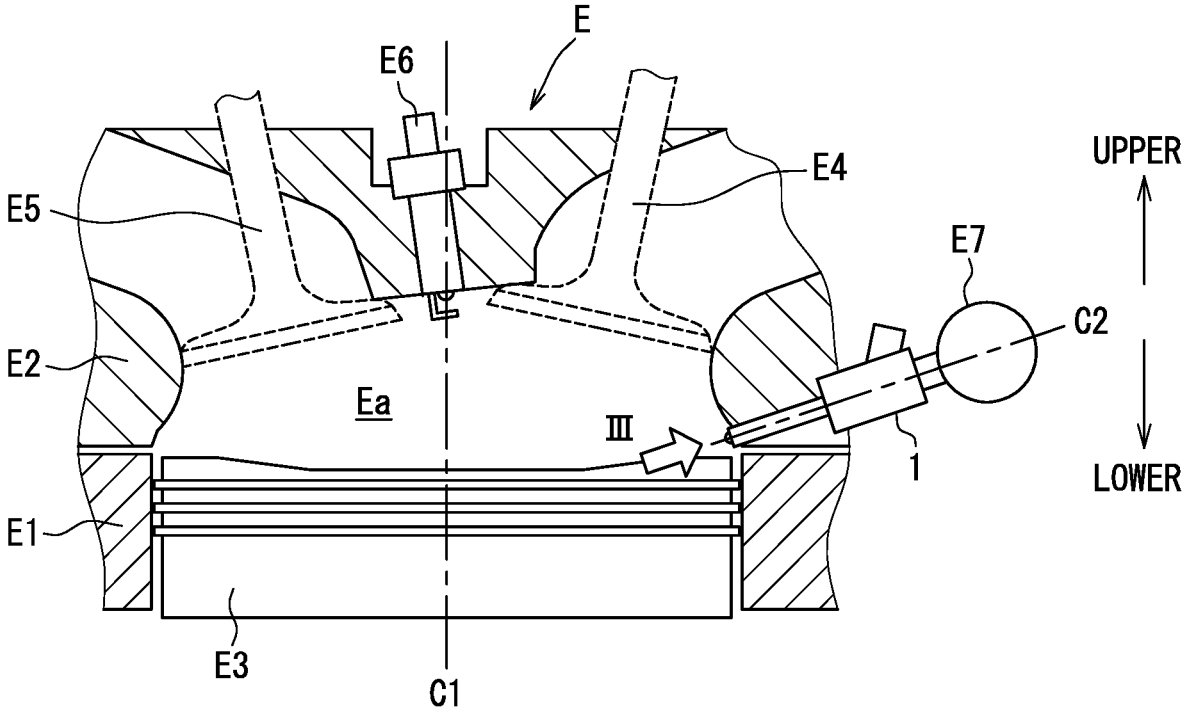
FIG. 2 is a view showing an engine mounted position of the fuel injection valve of FIG. 1.

A fuel injection valve 1 shown in FIG. 1 is mounted to a vehicle internal combustion engine (engine E) of an ignition type shown in FIG. 2. The engine E includes a cylinder E1, a cylinder head E2, and a piston E3. An intake valve E4, an exhaust valve E5, a spark plug E6, and the fuel injection valve 1 are mounted to the cylinder head E2. Two intake valves E4 and two exhaust valves E5 are provided. The spark plug E6 is arranged on a center axis C1 of the piston E3.

The fuel injection valve 1 is arranged on the side of the intake valve E4 with respect to the center axis C1 and is arranged on the side of the piston E3 with respect to the intake valve E4. The fuel injection valve 1 is of a side-direct injection type to inject fuel directly from the side of the combustion chamber Ea into the combustion chamber Ea. Therefore, a center line C2 of the fuel injection valve 1 intersects with the center axis C1 of the piston E3 at an angle of 45 degrees or more. The arrows indicating the vertical direction in FIG. 2 do not indicate the vertical direction when the engine E is mounted on the vehicle. The compression side of the piston E3 in the direction of the center axis C1 is on the upper side, and the expansion side of the piston E3 is on the lower side.

Figure 3:
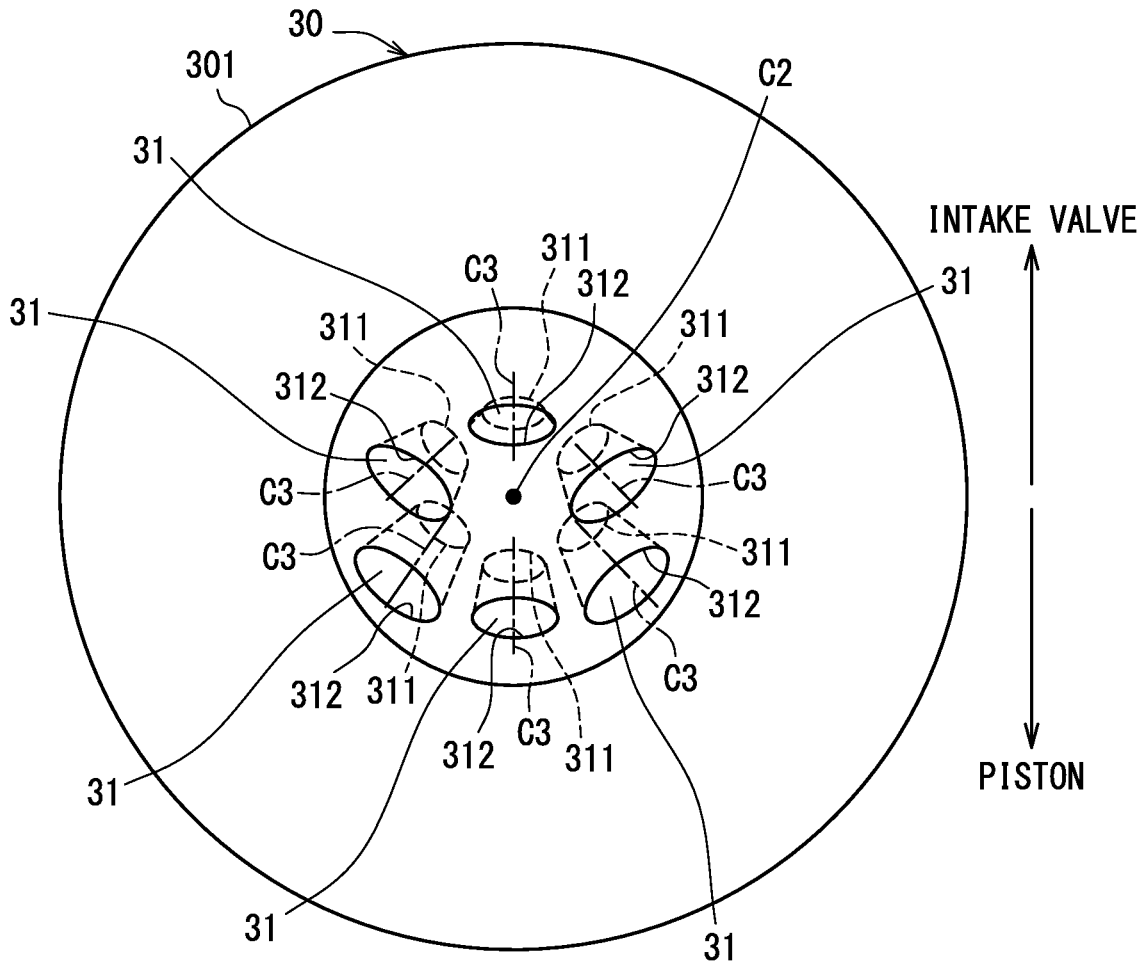
FIG. 3 is a view when viewed along the arrow III in FIG. 1.
Figure 4:
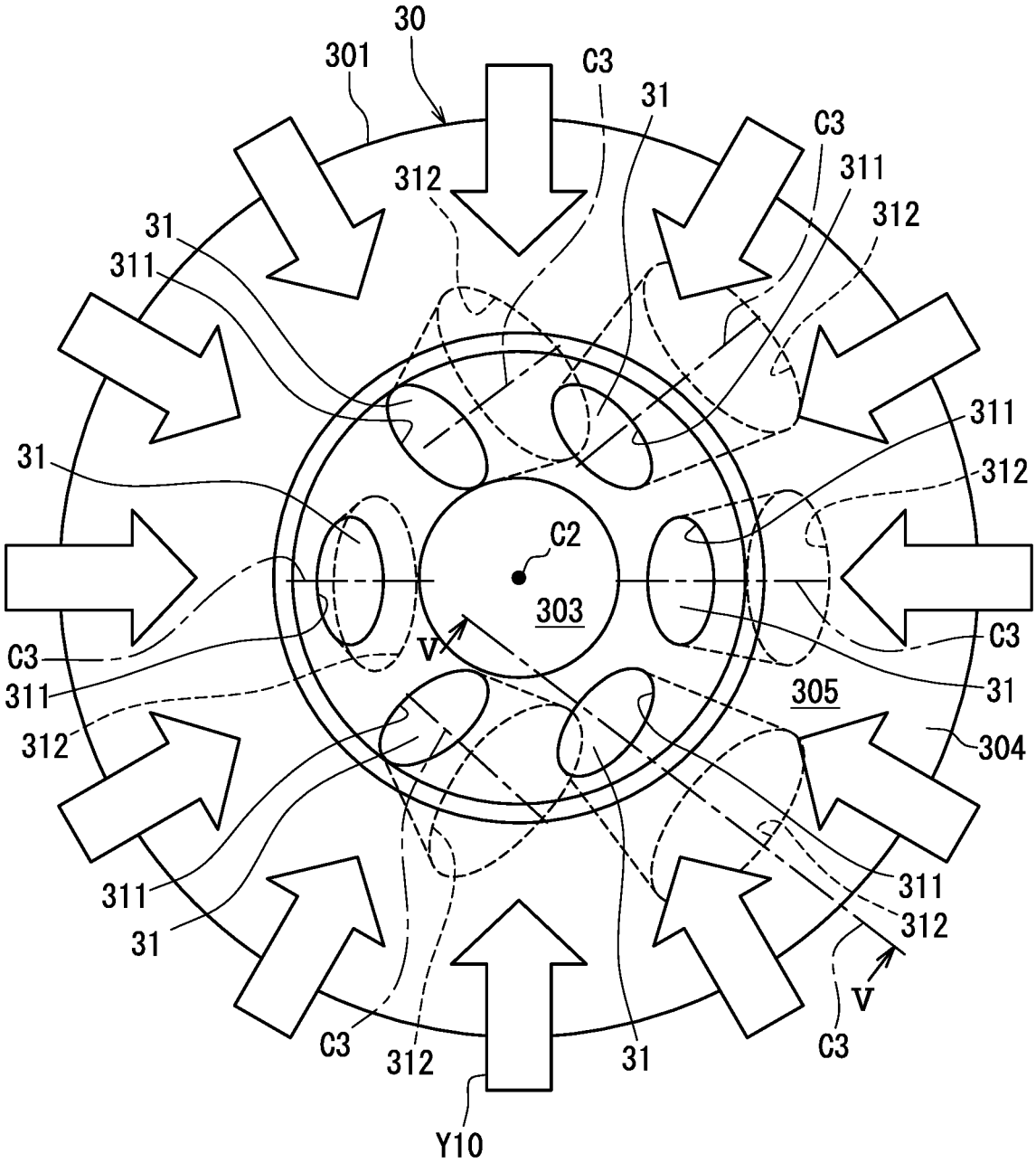
FIG. 4 is a cross-sectional view taken along the line IV-IV in FIG. 1.

As shown in FIGS. 1, 3 and 4, the fuel injection valve 1 has multiple injection holes 31 for injecting fuel. An inlet 311 of the injection hole 31 is arranged concentrically around the center line C2 of the fuel injection valve 1. an imaginary center line of the injection hole 31 extending from the center of the inlet 311 of the injection hole 31 toward the center of an outlet 312 of the injection hole 31 is referred to as an injection hole axis C3 which will be described in detail later. For all the injection holes 31, the direction of fuel (spray) injected from the outlet 312 is in the direction from the side of the intake valve E4 toward the side of the piston E3. All the injection hole axes C3 are oriented from the side of the intake valve E4 toward the side of the piston E3 when viewed from the horizontal direction shown in FIG. 2.

The fuel injection valve 1 includes a nozzle body 20, a needle 40, a movable core 47, a stationary core 44, a coil 38, springs 24, 26 and the like. The movable core 47, the stationary core 44, and the coil 38 function as a driving unit for opening and closing the needle 40. High-pressure fuel supplied from a delivery pipe E7 (see FIG. 2) to the fuel injection valve 1 passes through a fuel passage 18 formed inside the nozzle body 20 and is injected from the injection hole 31.

The nozzle body 20 includes a first tubular member 21, a second tubular member 22, a third tubular member 23, and an injection nozzle 30. The first tubular member 21, the second tubular member 22, and the third tubular member 23 are all substantially cylindrical members and are coaxially arranged in the order of the first tubular member 21, the second tubular member 22, and the third tubular member 23. The first tubular member 21, the second tubular member 22, and the third tubular member 23 are connected to each other.

The injection nozzle 30 is provided at the end of the first tubular member 21 on the opposite side of the second tubular member 22. The injection nozzle 30 is a bottomed tubular member and is welded to the first tubular member 21. The nozzle 30 is quenched so as to have a predetermined hardness. The injection nozzle 30 includes an injection portion 301 and a tubular portion 302.

The needle 40 is housed in the nozzle body 20 so as to be reciprocally movable in the direction of the center line C2. The tubular portion 302 forms an annular passage 305 in a tubular shape with the outer surface of the needle 40. The annular passage 305 extends in an annular form around the center line C2 to conduct fuel in the direction in which the center line C2 extends.

The injection portion 301 is a hollow hemispherical portion centered on a point on the center line C2 of the injection nozzle 30. The injection portion 301 forms a hemispherical distribution passage 303 (sack chamber) with the outer surface of a tip end of the needle 40. The upstream end of the distribution passage 303 communicates with the downstream end of the annular passage 305, and the downstream end of the distribution passage 303 communicates with the inlet 311 of the injection hole 31.

The distribution passage 303 collects fuel flowing through the annular passage 305 and distributed in an annular form. The distribution passage 303 distributes the collected fuel to the multiple inlets 311. The arrows in FIG. 4 indicate the flow directions of the fuel flowing from the annular passage 305 into the distribution passage 303. The fuel flows from the outside of the distribution passage 303 in the radial direction toward the center line C2. A part of the fuel flowing in this way flows directly into the inlet 311 of the injection hole 31, and the other part of fuel flows into the inlet 311 after being accumulated in the distribution passage 303. The annular passage 305 and the distribution passage 303 form a part of the fuel passage 18 described above.

A valve seat 304 that is in an annular is formed on the inner wall surface of the tubular portion 302. The needle 40 is configured to come into contact with the valve seat 304. The needle 40 is seated on the valve seat 304, thereby to close the annular passage 305 (valve close) and to stop fuel injection from the injection hole 31. The needle 40 is lifted from the valve seat 304, thereby to open the annular passage 305 (valve open) and to perform injection from the injection hole 31.

The movable core 47 is a substantially tubular member that has been subjected to a magnetic stabilization process. The movable core 47 is engaged with the needle 40. A stationary core 51 is subjected to a magnetic stabilization process. The stationary core 51 is a substantially tubular member. The stationary core 44 is welded to the third tubular member 23 of the nozzle body 20 and is fixed to the inside of the nozzle body 20.

The coil 38 is a substantially cylindrical member and mainly surrounds the radially outer side of the second tubular member 22 and the third tubular member 23. The coil 38 generates a magnetic field when supplied with electric power and forms a magnetic circuit that passes through the stationary core 44, the movable core 47, the first tubular member 21, and the third tubular member 23. In this way, the stationary core 44 and the movable core 47 generate a magnetic attraction force therebetween, thereby to attract the movable core 47 toward the stationary core 44 and to cause the needle 40 to perform valve opening.

The spring 24 urges the needle 40 together with the movable core 47 in the direction toward the valve seat 304, that is, in the valve closing direction. The spring 26 urges the movable core 47 in the direction opposite from the valve seat 304, that is, in the valve opening direction. In the present embodiment, the urging force of the spring 24 is set to be larger than the urging force of the spring 26. In this configuration, when power is not supplied to the coil 38, the seal portion of the needle 40 is in contact with the valve seat 304, that is, in the valve closing state.

Figure 5:
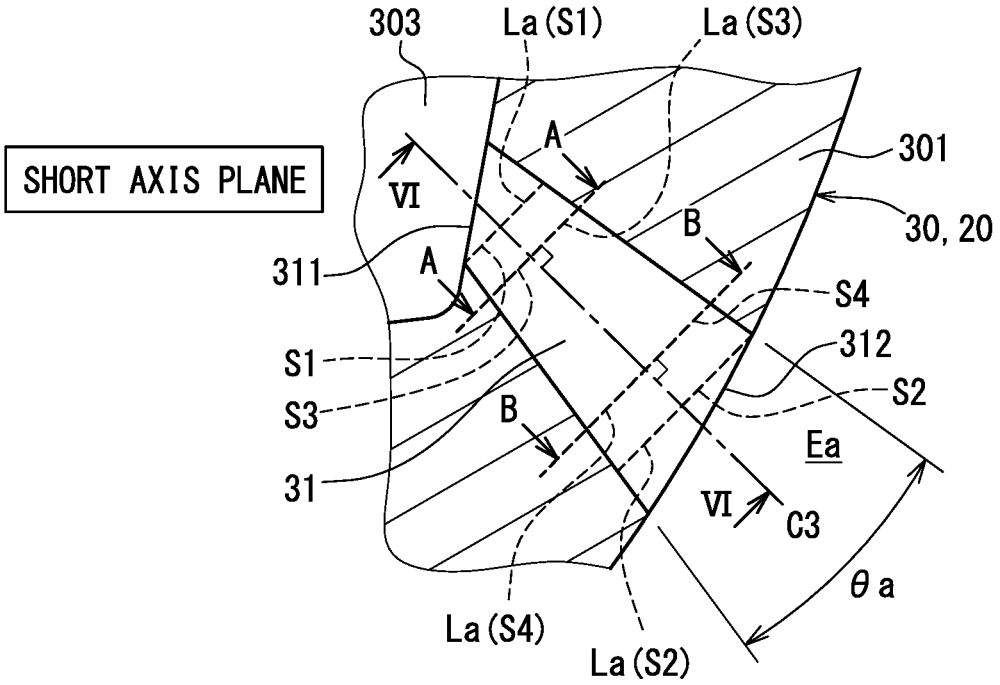
FIG. 5 is a cross-sectional view taken along the line V-V in FIG. 4.

Subsequently, the shape of the injection hole 31 will be described in detail with reference to FIGS. 5 to 7. In the following description, the cross section of the injection hole 31 perpendicular to the injection hole axis C3 is referred to as an injection hole perpendicular cross section S1, S2, S3, S4. As shown in FIG. 5, the planes along the inlet 311 and the outlet 312 are not perpendicular to the injection hole axis C3 but are inclined. The illustrated injection hole perpendicular cross section S1 is a cross section (inlet cross section) at the most upstream position of the injection hole 31 and has an opening shape that is different from an opening shape of the inlet 311. The illustrated injection hole perpendicular cross section S4 is a cross section (outlet cross section) at the most downstream position of the injection hole 31 and has an opening shape that is different from an opening shape of the outlet 312.

The injection hole perpendicular cross section has a flat shape at any position in the direction of the injection hole axis C3. The injection hole perpendicular cross section has a shape that gradually expands in the area while maintaining a similar shape from the inlet 311 to the outlet 312 (see FIG. 7). Specifically, the injection hole perpendicular cross section has an elliptical shape from the inlet 311 to the outlet 312 and has a short axis La and a long axis Lb. A ratio of the length of the short axis La to the length of the long axis Lb is constant at any position in the direction of the injection hole axis C3. That is, the injection hole 31 has a shape in which the ratio of the length of the short axis La to the length of the long axis Lb does not change from the inlet 311 to the outlet 312.

In the following description, the cross section of the injection hole 31 including the injection hole axis C3 is referred to as an injection hole longitudinal cross section, the plane of the injection hole longitudinal cross section including the short axis La is referred to as a short axis plane (see FIG. 5), and the plane including the long axis Lb in the injection hole longitudinal cross section is referred to as a long axis plane (see FIG. 6). The injection hole longitudinal cross section has a tapered shape in which the inner wall surface of the injection hole 31 linearly expands from the inlet 311 to the outlet 312.

Figure 6:
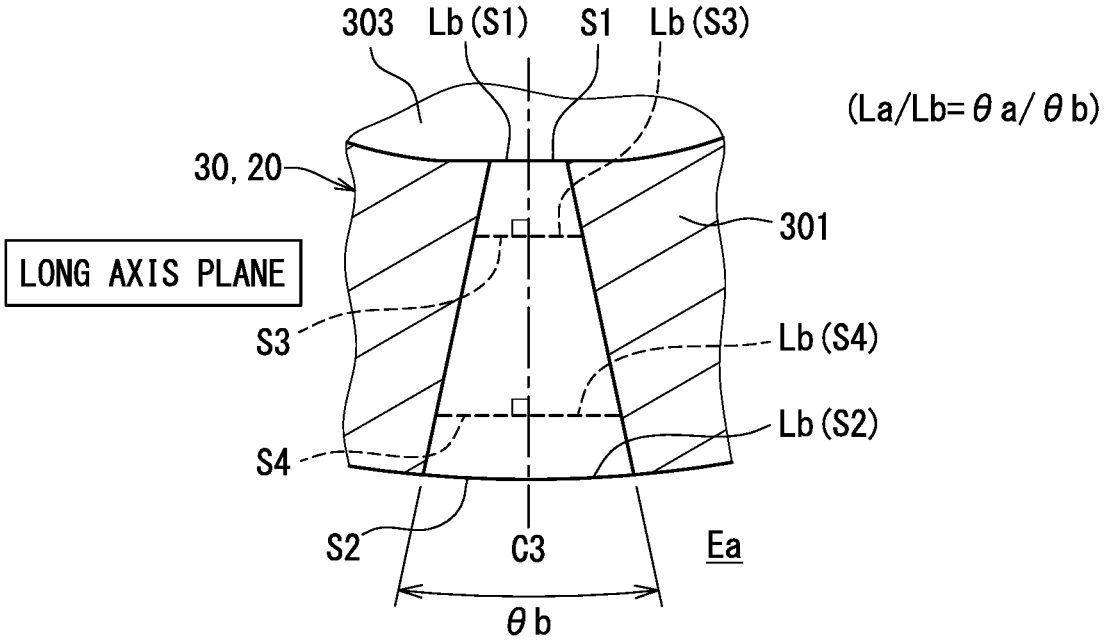
FIG. 6 is a cross-sectional view taken along the line VI-VI in FIG. 5.

A taper angle of the tapered shape appearing in the short axis plane is referred to as a short axis taper angle θa (see FIG. 5), and a taper angle of the tapered shape appearing in the long axis plane is referred to as a long axis taper angle θb (see FIG. 6). A ratio of the short axis taper angle θa to the long axis taper angle θb is the same as a ratio of the length of the short axis La to the length of the long axis Lb and is expressed as $\theta a/\theta b = La/Lb$.

Figure 7:
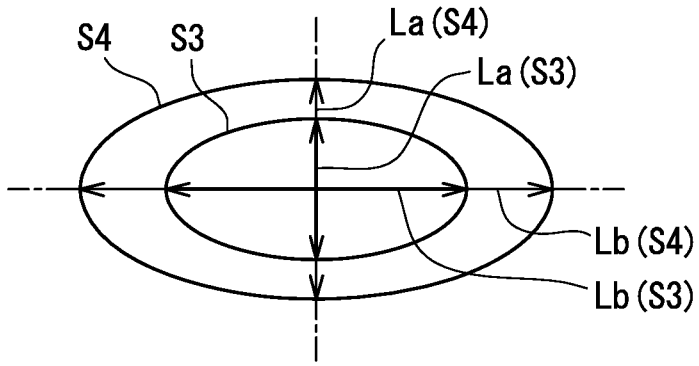
FIG. 7 is a view showing an injection hole perpendicular cross section at an A position on an injection hole axis and an injection hole perpendicular cross section at a B position on the injection hole axis.

Multiple injection holes 31 are formed in the nozzle body 20, and the shapes shown in FIGS. 5 to 7 are applied to each of the injection holes 31. These injection holes 31 are formed by applying laser machining to the nozzle body 20.

Subsequently, the definition of "injection hole axis C3" will be described with reference to FIGS. 8 to 13.

Figure 8:
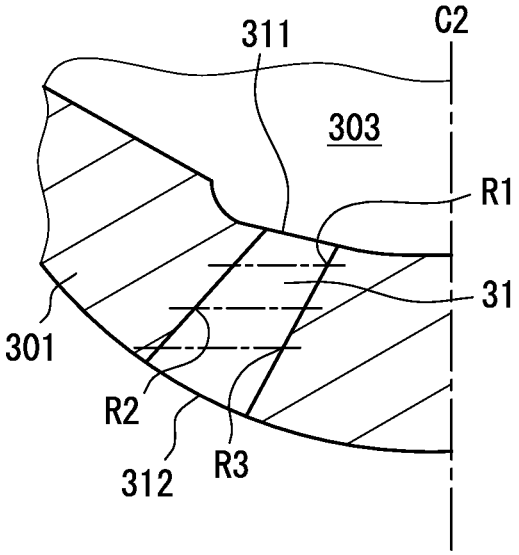
FIG. 8 is a cross-sectional view illustrating a definition of the injection hole nozzle axis.

As shown by the alternate long and short dash line in FIG. 8, in the injection hole 31, cross sections are defined at arbitrary three points. These cross sections are parallel to each other. These cross sections are, for example, horizontal cross sections perpendicular to the center line C2 of the nozzle body 20. The solid lines shown in FIGS. 9 and 10 are outlines R1, R2, and R3 of the injection hole 31 appearing in these horizontal cross sections.

Figure 9:
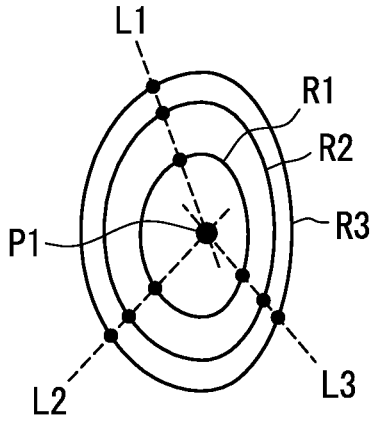
FIG. 9 is a view illustrating the definition of the injection hole nozzle axis.
Figure 10:
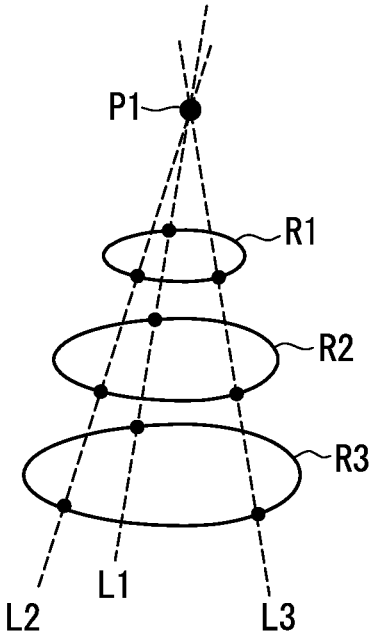
FIG. 10 is a perspective view illustrating the definition of the injection hole nozzle axis.

Imaginary straight lines L1, L2, and L3 shown by the dotted lines in FIGS. 9 and 10 are straight lines respectively passing through arbitrary points of the three outlines R1, R2, and R3. A first intersection P1 in the drawing is an intersection of the three imaginary straight lines L1, L2, and L3.

Figure 11:
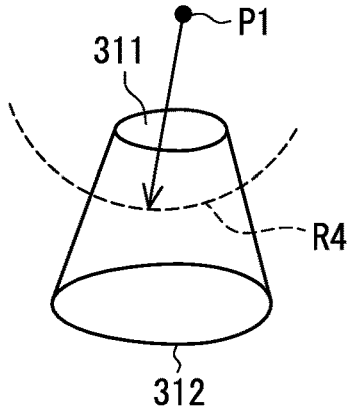
FIG. 11 is a perspective view illustrating the definition of the injection hole nozzle axis.
Figure 12:
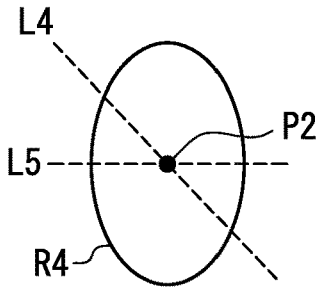
FIG. 12 is a view illustrating the definition of the injection hole nozzle axis.
Figure 13:
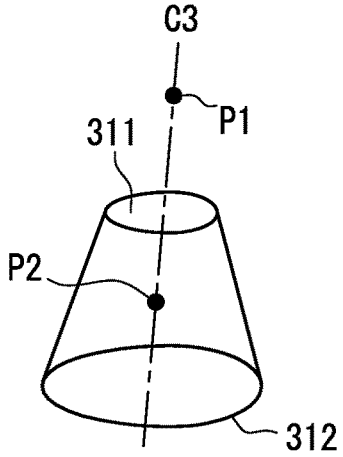
FIG. 13 is a perspective view illustrating the definition of the injection hole nozzle axis.

An imaginary circle R4 shown by the dotted line in FIG. 11 is a circle that is at a constant distance from the first intersection P1 and is located on an inner wall surface of the injection hole 31. Each of imaginary straight lines L4 and L5 in FIG. 12 is a straight line that bisects a circumferential length of the imaginary circle R4. The second intersection P2 in the drawing is an intersection of the two imaginary straight lines L4 and L5. As shown in FIG. 13, a straight line passing through the first intersection P1 and the second intersection P2 is defined as "injection hole axis C3".

As described above, according to the present embodiment, the perpendicular cross section of the injection hole has an elliptical shape. In addition, the injection hole perpendicular cross section has a shape in which the area of the injection hole 31 gradually expands from the inlet 311 to the outlet 312 while maintaining its analog shape. Further, the injection hole perpendicular cross section has a shape that is an elliptical shape and that gradually expands in area from the inlet 311 to the outlet 312. The injection hole 31 has a shape in which the ratio of the length of the short axis La to the length of the long axis Lb does not change from the inlet 311 to the outlet 312.

Therefore, compared to an example of a configuration in which the shape of the injection hole perpendicular cross section changes according to the position on the injection hole axis C3 in a complicated manner, the configuration enables to facilitate laser-machining of the shape of the injection hole perpendicular cross section according to the position on the injection hole axis C3 into a desired shape. Therefore, the configuration enables to form the injection hole 31 to have an elliptical shape and to have a shape in which the area gradually expands while suppressing deterioration of the accuracy of the spray shape due to deterioration of the accuracy of the injection hole shape.

Fuel flowing through the injection hole 31 does not necessarily flow while entirely filling the injection hole perpendicular cross section but flows while partially filling a region of the injection hole perpendicular cross section that is along the inner wall surface of the injection hole. That is, the fuel that flows from the inlet 311 of the injection hole 31 flows through the injection hole while being in a state of a liquid film along the inner wall surface of the injection hole 31 and is injected from the outlet 312. Therefore, in the present embodiment, the injection hole 31 is formed to have an elliptical shape thereby to enable to promote thinning of the liquid film. As a result, the configuration enables to promote atomization of fuel (spray) injected from the outlet 312 and to promote reduction in penetration.

Further, in the fuel injection valve 1 according to the present embodiment, the injection hole perpendicular cross section has the shape in which its area gradually expands from the inlet 311 to the outlet 312 of the injection hole 31. This configuration also promotes atomization of the spray and reduction in penetration.

Figure 14:
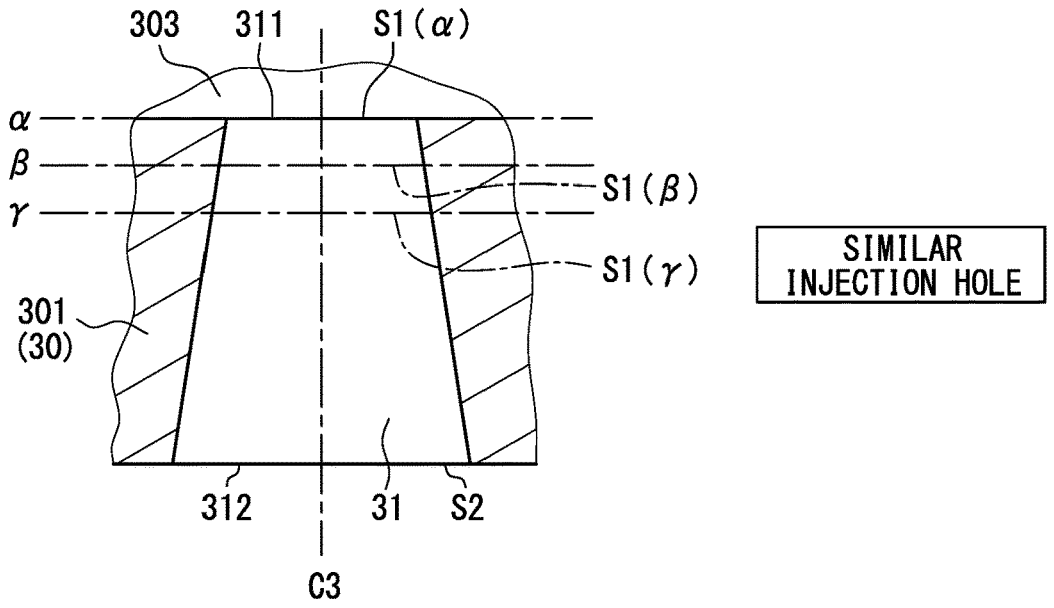
FIG. 14 is a cross-sectional view schematically showing a difference in the wall thickness of a nozzle body in the first embodiment.

Subsequently, the reason why the configuration enables to facilitate laser-machining of the shape of the injection hole perpendicular cross section into a desired shape will be described in detail with reference to FIGS. 14 to 21. In FIG. 14, for easy understanding, the shape of the injection hole perpendicular cross section S1 (inlet cross section) is shown assuming that the shape of the injection hole perpendicular cross section S1 is the same as the opening shape of the inlet 311.

Figure 15:
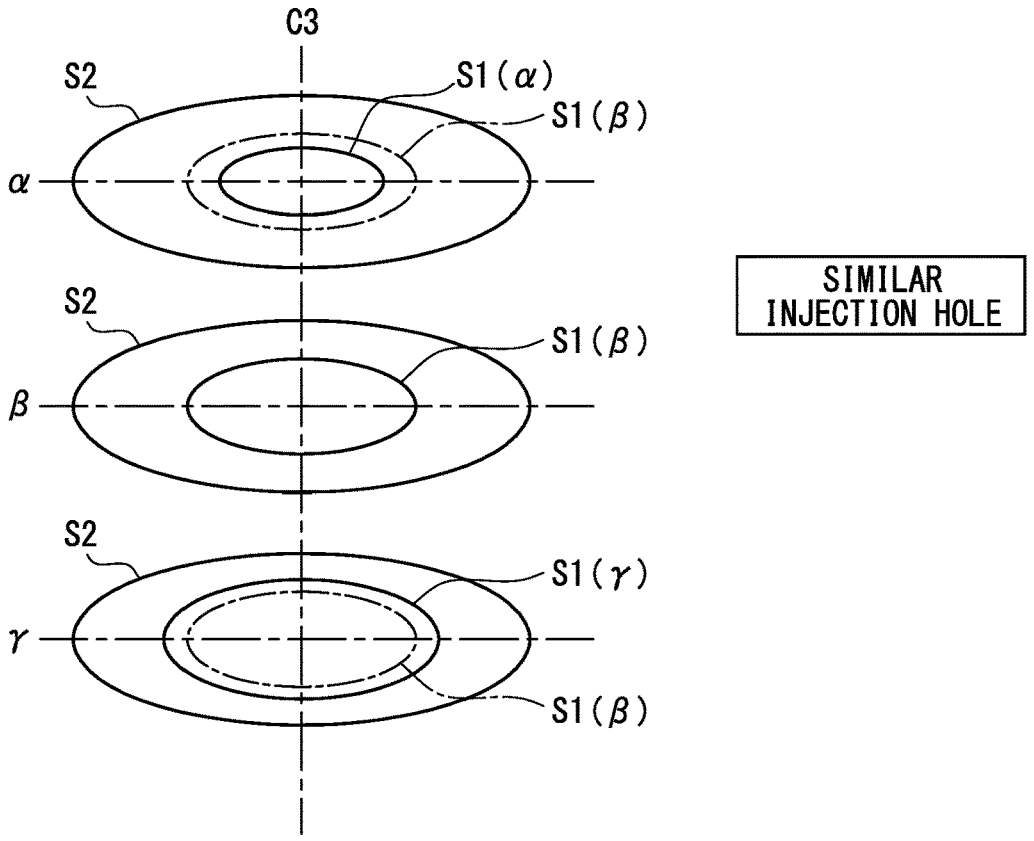
FIG. 15 is a perspective view showing a difference in the shape of the inlet corresponding to the difference in the wall thickness shown in FIG. 14.

The alternate long and short dash lines α, β, and γ in FIG. 14 indicate a state in which the wall thickness of the injection portion 301 of the injection nozzle 30 differs due to manufacturing variations. That is, the thinner the wall thickness is, the shorter the length of the injection hole 31 in the direction of the injection hole axis C3 is, and the position of the injection hole perpendicular cross section S1 (inlet cross section) approaches the injection hole perpendicular cross section S2 (outlet cross section). The solid line S1 (α) shown in the upper part of FIG. 15 shows the inlet cross section when the wall thickness of the injection portion 301 is the thickness shown by the alternate long and short dash line α. The solid line S1 (β) shown in the middle part of FIG. 15 shows the inlet cross section when the wall thickness of the injection portion 301 is the thickness shown by the alternate long and short dash line β. The solid line S1 (γ) shown in the lower part of FIG. 15 shows the inlet cross section when the wall thickness of the injection portion 301 is the thickness shown by the alternate long and short dash line γ.

The shape of the injection hole perpendicular cross sections according to the present embodiment are the similar shapes, regardless of the position on the injection hole axis C3 at which the cross section resides, and the short axis La/long axis Lb ratio does not change. Therefore, even in a case where the wall thickness of the injection portion 301 varies as shown by the alternate long and short dash lines α, β, and γ, the shape of the inlet cross section differs only in size, and the short axis La/long axis Lb ratio is the same. (See FIG. 15). Further, the ratio of the short axis taper angle θa to the long axis taper angle θb is the same as the ratio of the length of the short axis La to the length of the long axis Lb.

Figure 16:
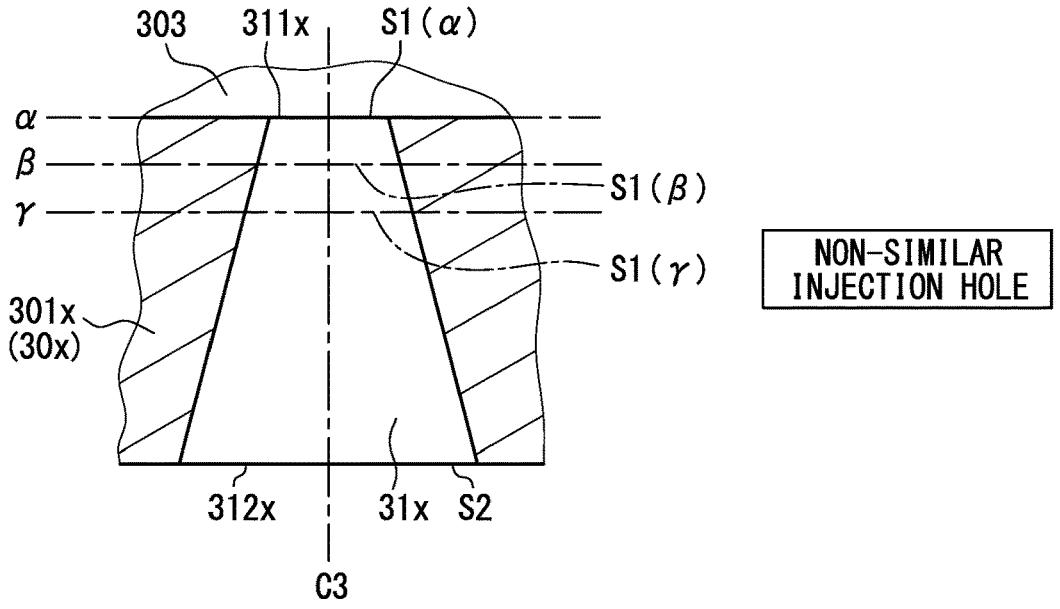
FIG. 16 is a cross-sectional view schematically showing a difference in the wall thickness of a nozzle body in an comparative example.
Figure 17:
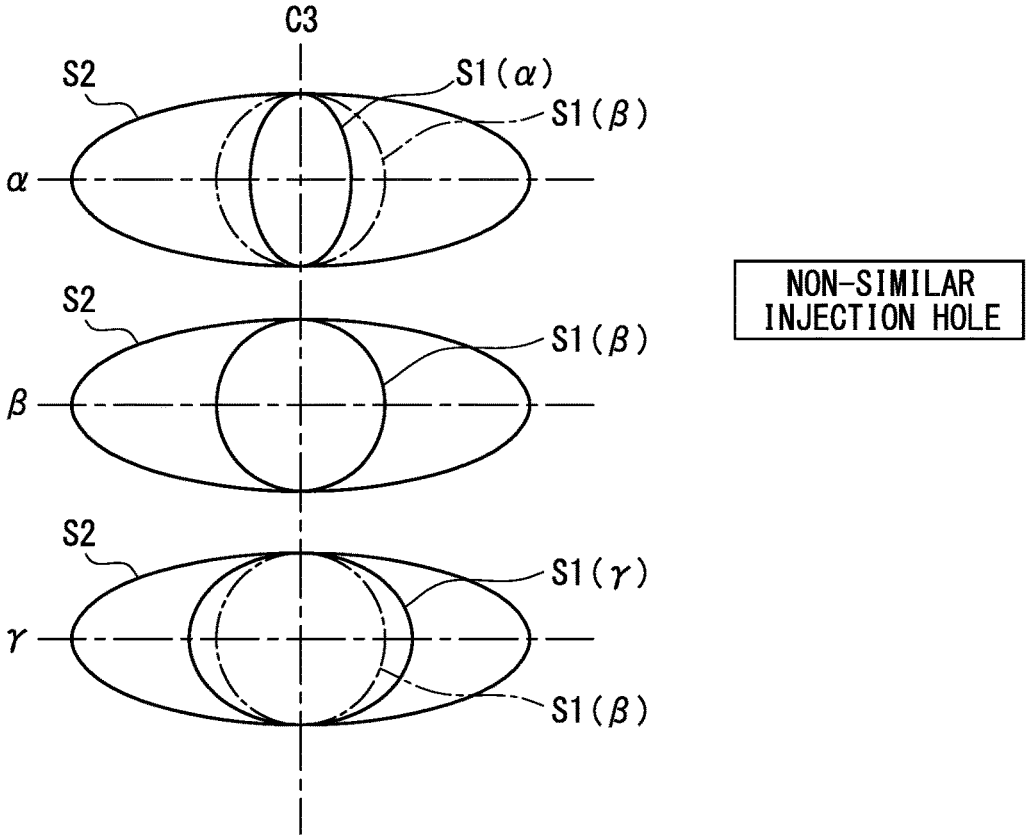
FIG. 17 is a perspective view showing a difference in the shape of the inlet corresponding to the difference in the wall thickness shown in FIG. 16.

FIG. 16 shows a comparative example of the present embodiment, in which an injection portion 301*x* and an injection hole 31*x* of an injection nozzle 30*x*, and in which the shape of the perpendicular cross section of the injection hole changes in a non-similar form according to the position on the injection hole axis C3 to the contrary. In addition, the short axis/long axis ratio of the injection hole perpendicular cross section changes according to the position on the injection hole axis C3. Therefore, in a case where the wall thickness of the injection portion 301*x* varies as shown by the alternate long and short dash lines α, β, and γ, the shapes of the inlet cross sections differ in size, and the short axis/long axis ratios also differ (see FIG. 17).

Figure 18:
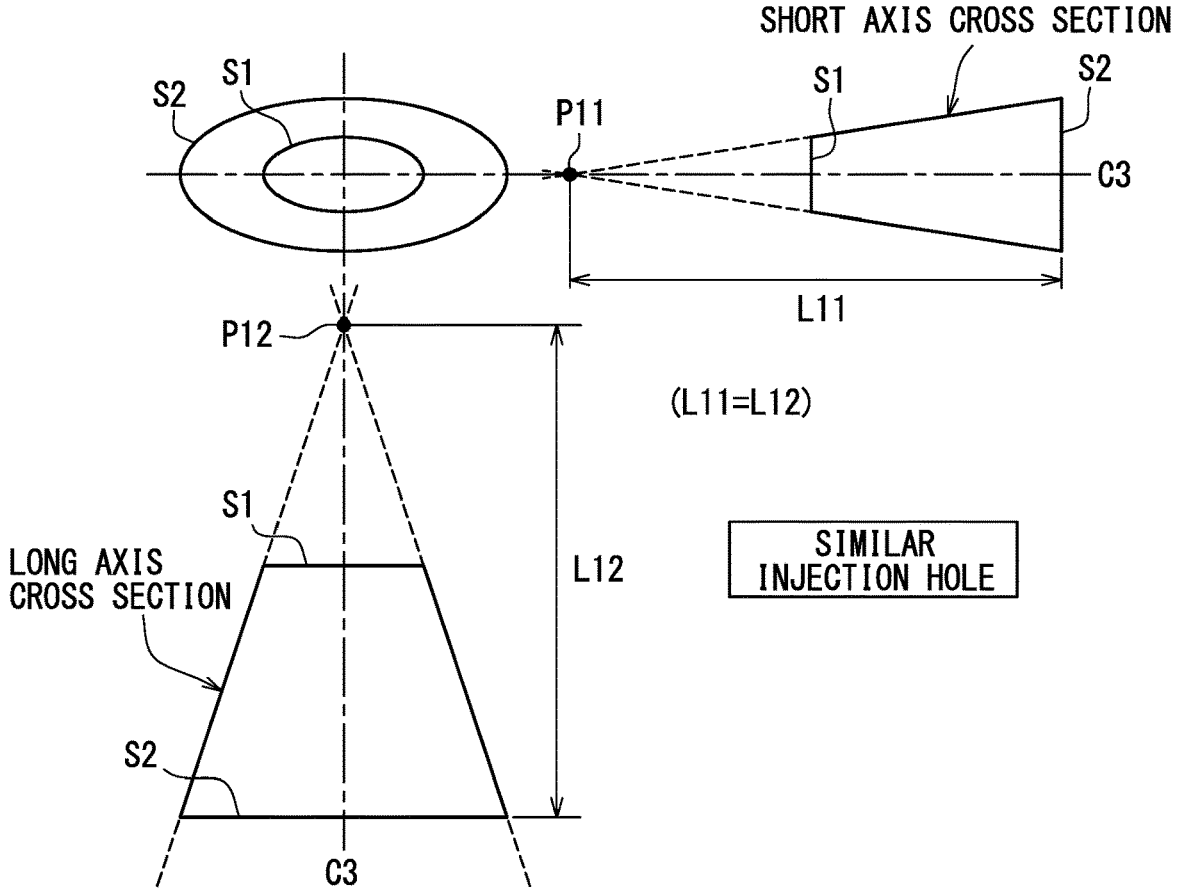
FIG. 18 is a trihedral view schematically showing the injection hole according to the first embodiment and showing a positional relationship between a focal point of laser beam and the injection hole.
Figure 19:
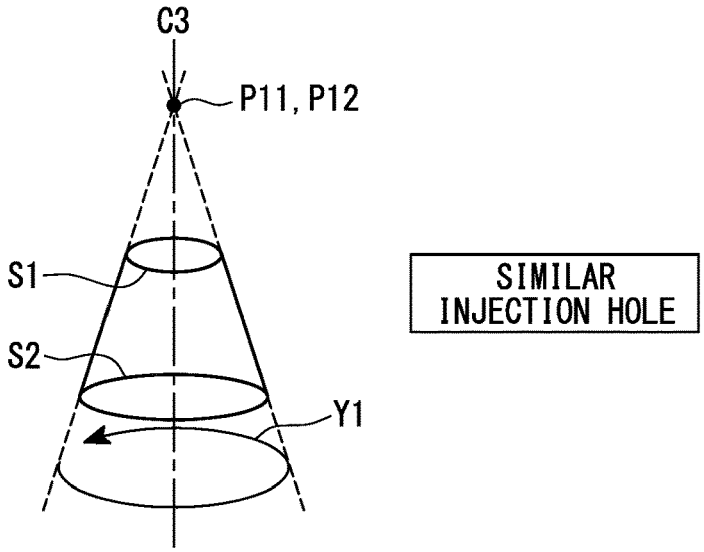
FIG. 19 is a perspective view of FIG. 18.

FIGS. 18 and 19 show a focal point P11 and P12 of the laser beam when the laser beam is emitted from the side of the outlet 312 toward the side of the inlet 311 when laser machining of the injection hole 31 according to the present embodiment is performed. The shape of the injection hole perpendicular cross sections according to the present embodiment are the similar shapes, regardless of the position on the injection hole axis C3 at which the cross section resides, and the short axis La/long axis Lb ratio does not change. Therefore, the two intersection distances L11 and L12 described below are constant.

The intersection distance L11 is a distance from a point (focal point P11), at which the inner wall surfaces of the injection hole 31 appearing in the short axis cross section are extended and intersect to each other, to the injection hole perpendicular cross section S2 (outlet cross section). The intersection distance L12 is a distance from a point (focal point P12), at which the inner wall surfaces of the injection hole 31 appearing in the long axis cross section are extended and intersect to each other, to the injection hole perpendicular cross section S2 (outlet cross section).

Therefore, the focal point P11 of the laser beam for laser machining the inner wall surface of the injection hole 31 appearing in the short axis cross section and the focal point P12 of the laser beam for laser machining the inner wall surface of the injection hole 31 appearing in the long axis cross section coincide with each other. Therefore, the injection hole 31 can be laser-machined by turning an emission nozzle (not shown) that emits the laser light on the same plane as shown by an arrow Y1 without moving the emission nozzle in the direction of the injection hole axis C3.

Figure 20:
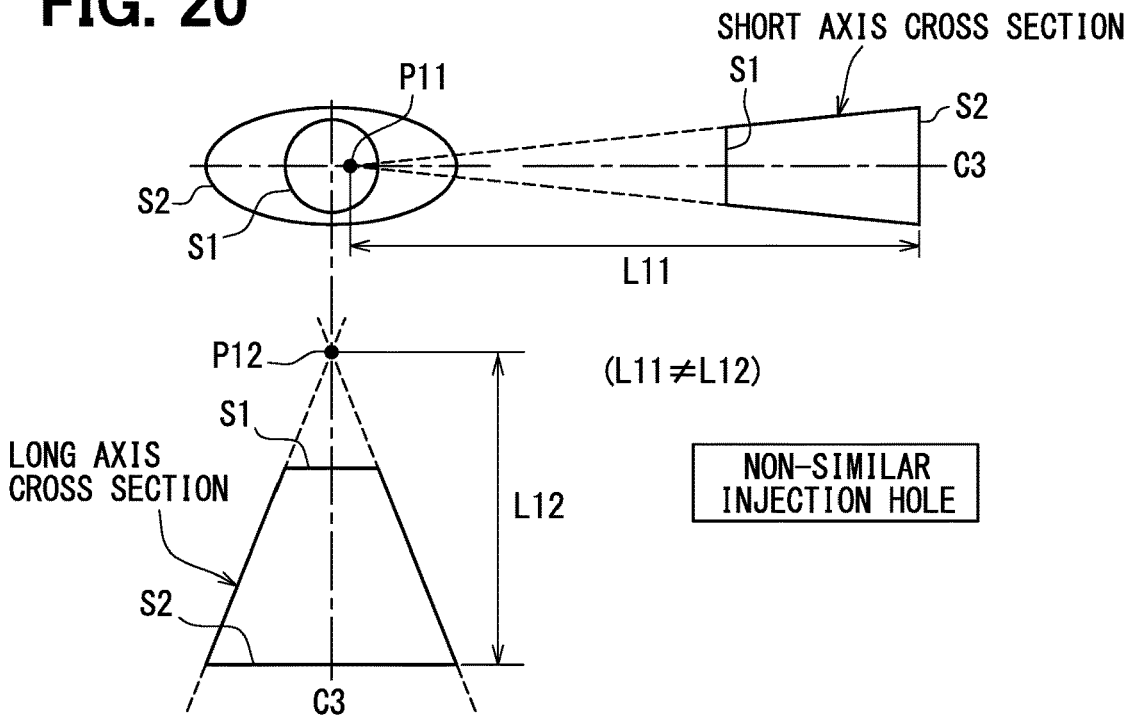
FIG. 20 is a trihedral view schematically showing the injection hole according to the comparative example shown in FIG. 16 and showing a positional relationship between a focal point of laser beam and the injection hole.
Figure 21:
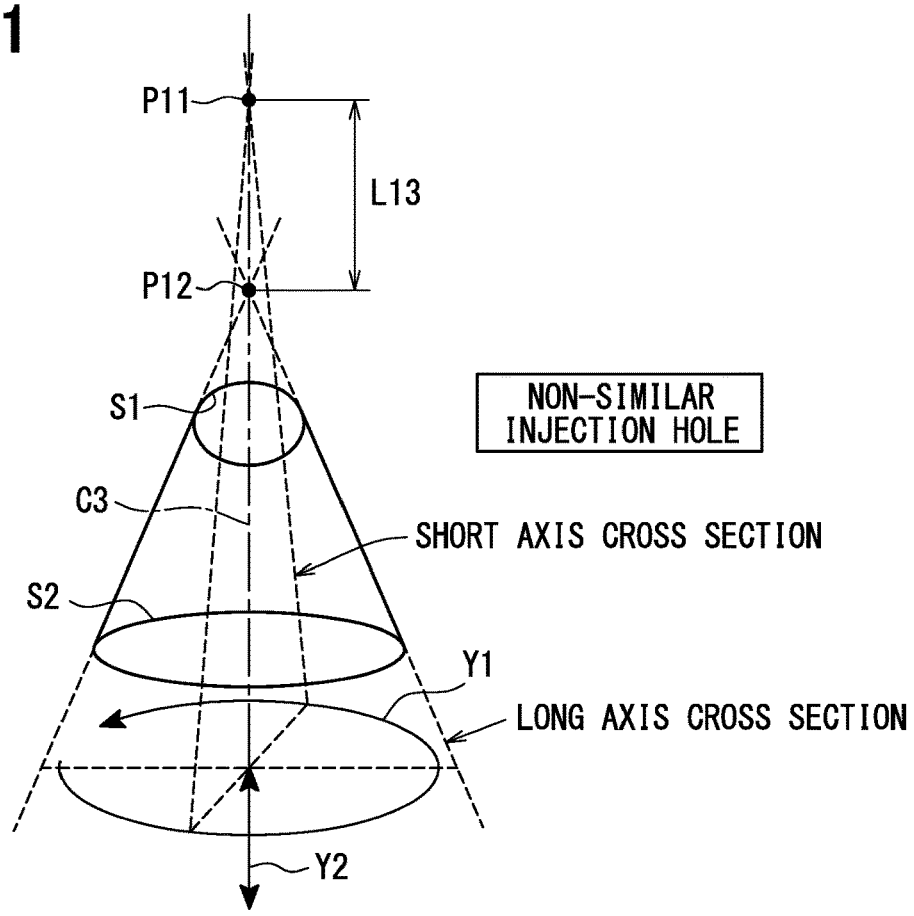
FIG. 21 is a perspective view of FIG. 20.

To the contrary, in the case of the injection nozzle 30*x* according to the comparative example shown in FIG. 16, as shown in FIG. 20, two intersection distances L11 and L12 are different. Therefore, the focal point P11 of the laser beam for laser machining the inner wall surface of the injection hole 31 appearing in the short axis cross section and the focal point P12 of the laser beam for laser machining the inner wall surface of the injection hole 31 appearing in the long axis cross section do not coincide with each other. In the example shown in FIG. 21, a difference arises between the intersection distances L11 and L12 by a length L13 in the direction of the injection hole axis C3. Therefore, the injection hole 31 can be laser-machined by turning the emission nozzle that emits the laser light as shown by the arrow Y1 while moving the emission nozzle in the direction of the injection hole axis C3 as shown by an arrow Y2.

As described above, the shape of the injection hole 31 according to the present embodiment enables laser machining of the injection hole 31 by rotating the emission nozzle without moving the emission nozzle in the direction of the injection hole axis C3. Therefore, as compared with the case of the comparative example that requires to rotate the emission nozzle while moving the emission nozzle in the direction of the injection hole axis C3, the configuration enables to facilitate the machining of the shape of the perpendicular cross section of the injection hole, which expands according to the position on the injection hole axis C3, into a desired shape.

Further, as described above with reference to FIGS. 14 to 17, according to the present embodiment, the configuration enables to suppress variation in the shape of the inlet cross section of the injection hole 31 due to the variation in the plate thickness of the nozzle body 20 by forming the inlet cross sections in the similar shapes as described above and setting the short axis/long axis ratio to be constant. Therefore, the configuration enables to suppress deterioration of the accuracy of the spray shape effectively.

The injection hole longitudinal cross section according to the present embodiment has the tapered shape in which the inner wall surface of the injection hole 31 linearly expands from the inlet 311 to the outlet 312. Therefore, the configuration enables to facilitate the laser machining as compared with a configuration in which a curved shape is employed such that the inner wall surface is enlarged in a curved form.

Further, in the present embodiment, the inlets 311 of the multiple injection holes 31 are arranged concentrically around the center line C2 of the nozzle body 20. The fuel passage 18 includes the annular passage 305, which extends in the annular form around the center line C2 to conduct fuel in the direction in which the center line C2 extends, and the distribution passage 303, which is for collecting the fuel flowing through the annular passage 305 and for distributing the fuel to the multiple inlets 311. Therefore, the configuration enables to promote equalization of the flow rate of the fuel flowing into the injection holes 31 and to suppress unevenness of the inflow flow rate.

Second Embodiment

In the first embodiment, the outlet 312 of the injection hole 31 is located on the outer surface of the injection portion 301. To the contrary, according to the present embodiment shown in FIG. 22, a recess 32 is formed on an outer surface 301*a* of the injection portion 301, and the injection hole 31 is formed in the recess 32. Therefore, the outlet 312 of the injection hole 31 is located at a position recessed toward the inlet 311 relative to the outer surface 301*a* of the injection portion 301. By forming the recess 32 in this way, the length of the injection hole axis C3 of the injection hole 31 is shortened. The recess 32 has a tubular shape formed coaxially with the injection hole axis C3. Similarly to the first embodiment, the shape of the injection hole perpendicular cross sections is the similar shape, regardless of the position on the injection hole axis C3 at which the cross section resides, and the short axis La/long axis Lb ratio does not change.

Figure 22:
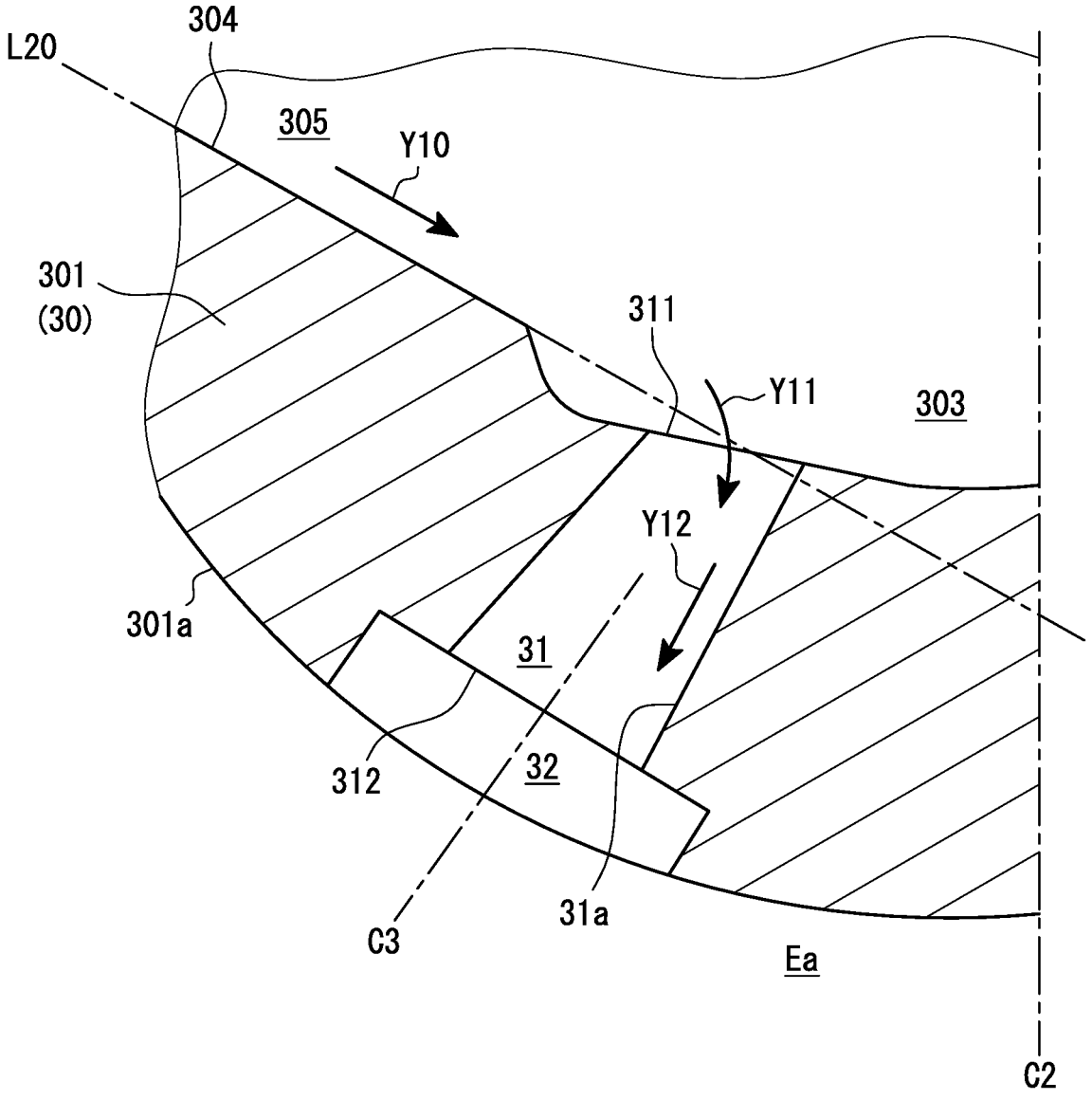
FIG. 22 is a cross-sectional view showing the shape of the injection hole according to a second embodiment.
Figure 23:
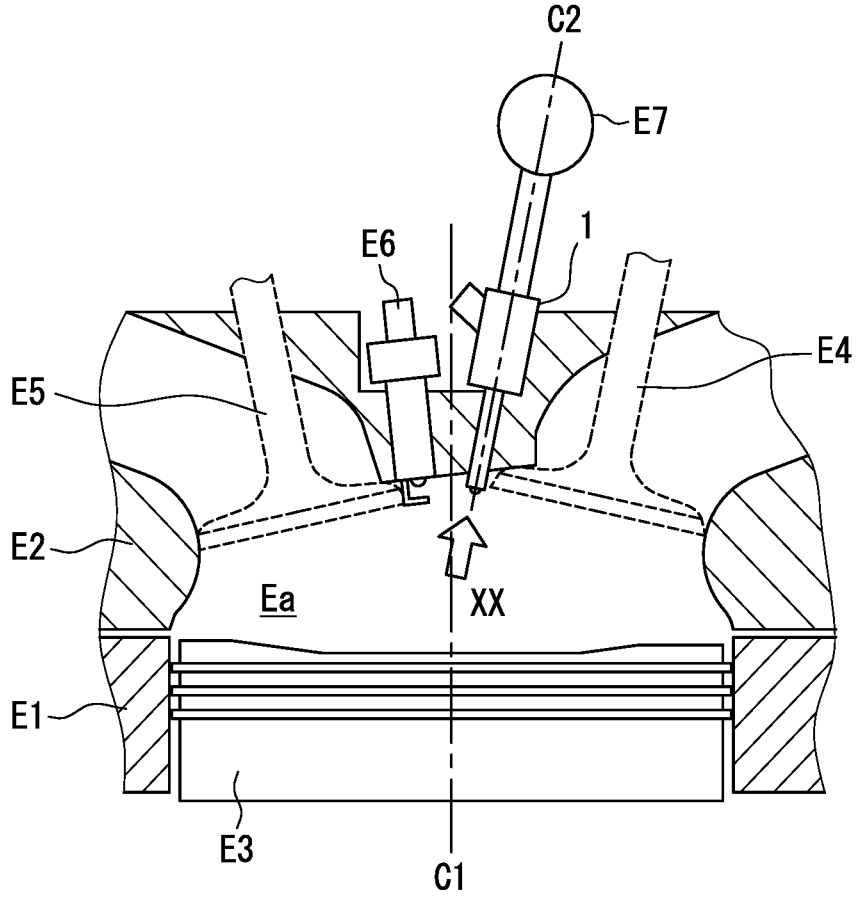
FIG. 23 is a view showing the engine mounted position of the fuel injection valve according to the third embodiment.

An imaginary line L20 in FIG. 22 is an extension of the surface of the valve seat 304, and a part of the imaginary line L20 is located inside the injection hole 31. Therefore, fuel flowing from the annular passage 305 to the distribution passage 303 along the valve seat 304 (see arrow Y10) flows into the inlet 311 while colliding with an inner wall surface 31*a* of the inner wall surface of the injection hole 31 that is closer to the center line C2 (see arrow Y11). Therefore, the configuration enables to promote thinning of the fuel (see arrow Y12) flowing in the injection hole 31 in a state of being a liquid film along the inner wall surface 31*a*.

Third Embodiment

As shown in FIG. 2, the fuel injection valve 1 according to the first embodiment is of a side direct injection type that injects fuel directly from the lateral side of the combustion chamber Ea into the combustion chamber Ea. To the contrary, as shown in FIG. 3, the fuel injection valve 1 according to the present embodiment is of a center direct injection type that injects fuel directly from the upper side of the combustion chamber Ea into the combustion chamber Ea. Specifically, the fuel injection valve 1 is arranged between the intake valve E4 and the exhaust valve E5. The center line C2 of the fuel injection valve 1 is at an angle that is less than 45 with respect to the center axis C1 of the piston E3 and intersects with the center axis C1.

Figure 24:
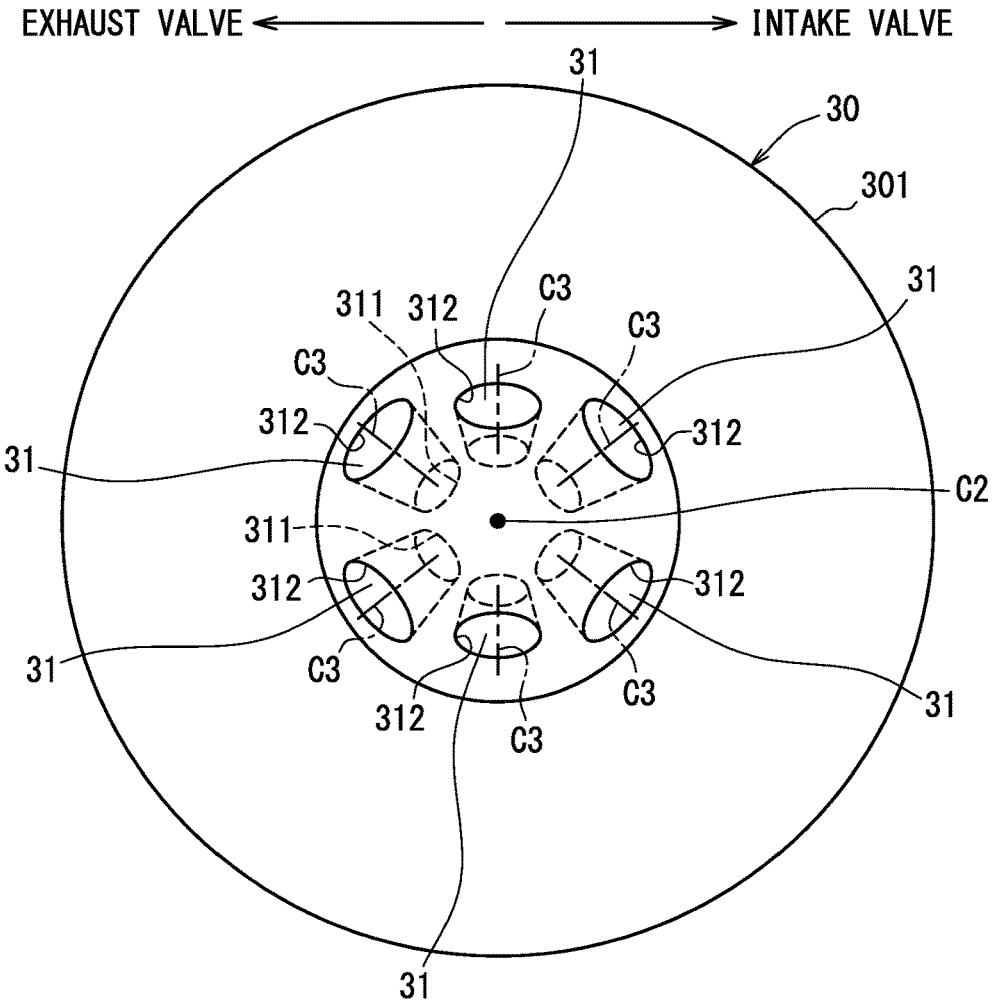
FIG. 24 is a view when viewed along the arrow XXIV in FIG. 23.

As shown in FIG. 24, the multiple inlets 311 of the injection hole 31 are arranged concentrically around the center line C2 of the fuel injection valve 1. For all the injection holes 31, the fuel (sprays) injected from the outlets 312 are in directions that extend from the center line C2 outward in the radial direction. All the injection hole axes C3 are directed such that as the injection hole axes C3 are closer to the downstream side of the nozzle 31, the injection hole axes C3 are directed away from the center line C2.

Similarly to the first embodiment, the shape of the injection hole perpendicular cross sections according to the present embodiment is the similar shape, regardless of the position on the injection hole axis C3 at which the cross section resides, and the short axis La/long axis Lb ratio does not change.

Fourth Embodiment

Figure 25:
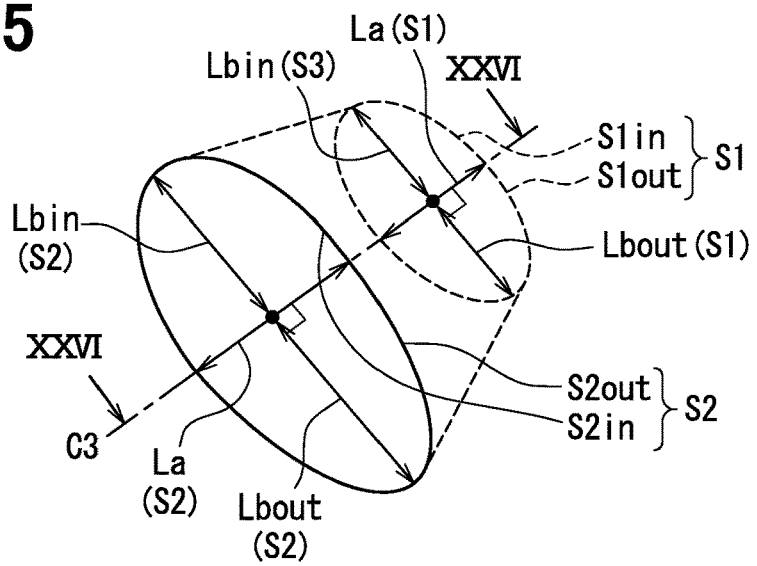
FIG. 25 is a perspective view showing the shape of the injection hole according to a fourth embodiment.

In the first embodiment, the injection hole perpendicular cross section has the elliptical shape. To the contrary, according to the present embodiment, as shown in FIG. 25, the injection hole perpendicular cross sections have a combination of two semi-ellipse shapes having long axes Lbin and Lbout that are different in length while sharing the short axis La from the inlet 311 to the outlet 312. In the two semi-ellipses, the semi-ellipse on the side closer to the center line C2 of the nozzle body 20 is referred to as an inner semi-ellipse S1*in* and S2*in*, and the semi-ellipse on the other side is referred to as an outer semi-ellipse S1*out* and S2*out*. The injection hole 31 has a shape in which a long axis Lbout of the outer semi-ellipse S1*out* and S2*out* is longer than a long axis Lbin of the inner semi-ellipse S1*in* and S2*in* throughout the entirety from the inlet 311 to the entire outlet 312.

Figure 26:
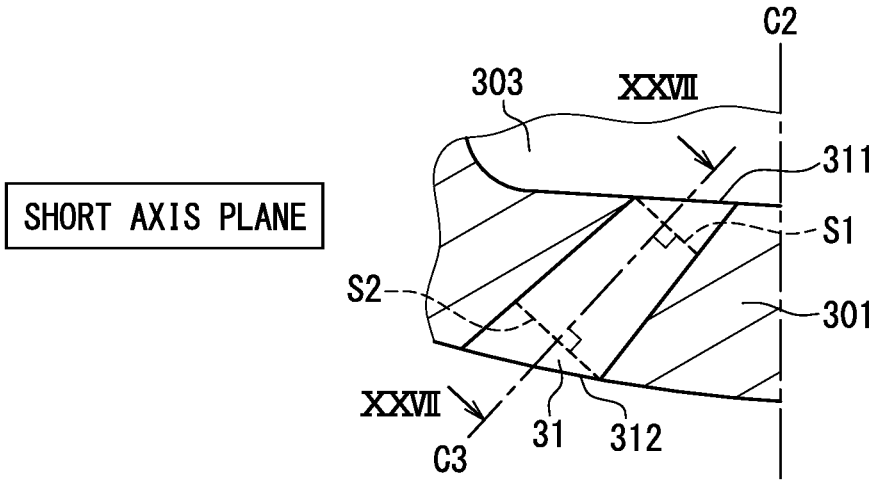
FIG. 26 is a cross-sectional view taken along the line XXVI-XXVI in FIG. 25.
Figure 27:
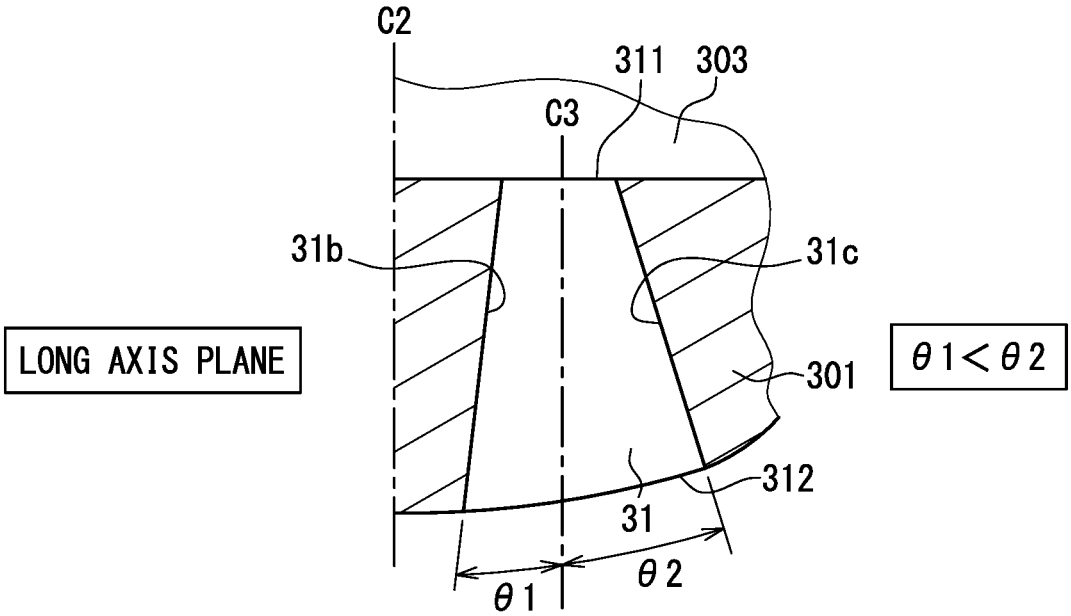
FIG. 27 is a cross-sectional view taken along the line XXVII-XXVII in FIG. 26.

As shown in FIG. 26, the shape of the injection hole 31 in the short axis plane is symmetrical with respect to the injection hole axis C3. As shown in FIG. 27, the shape of the injection hole 31 in the long axis plane is asymmetrical with respect to the injection hole axis C3. In the following description, in the long axis plane, the wall surface of the inner wall surface of the injection hole 31 on the side closer to the center line C2 is referred to as an inner wall surface 31*b*, and the wall surface of the inner wall surface of the injection hole 31 on the side farther from the center line C2 is referred to as an outer wall surface 31*c*. Further, in the long axis plane, the angle between the inner wall surface 31*b* and the injection hole axis C3 is referred to as an inner taper angle θ1, and the angle between the outer wall surface 31*c* and the injection hole axis C3 is referred to as an outer taper angle θ2. The inner taper angle θ1 is set to a value smaller than the outer taper angle θ2. In the short axis plane, the inner taper angle and the outer taper angle are the same value.

Figure 28:
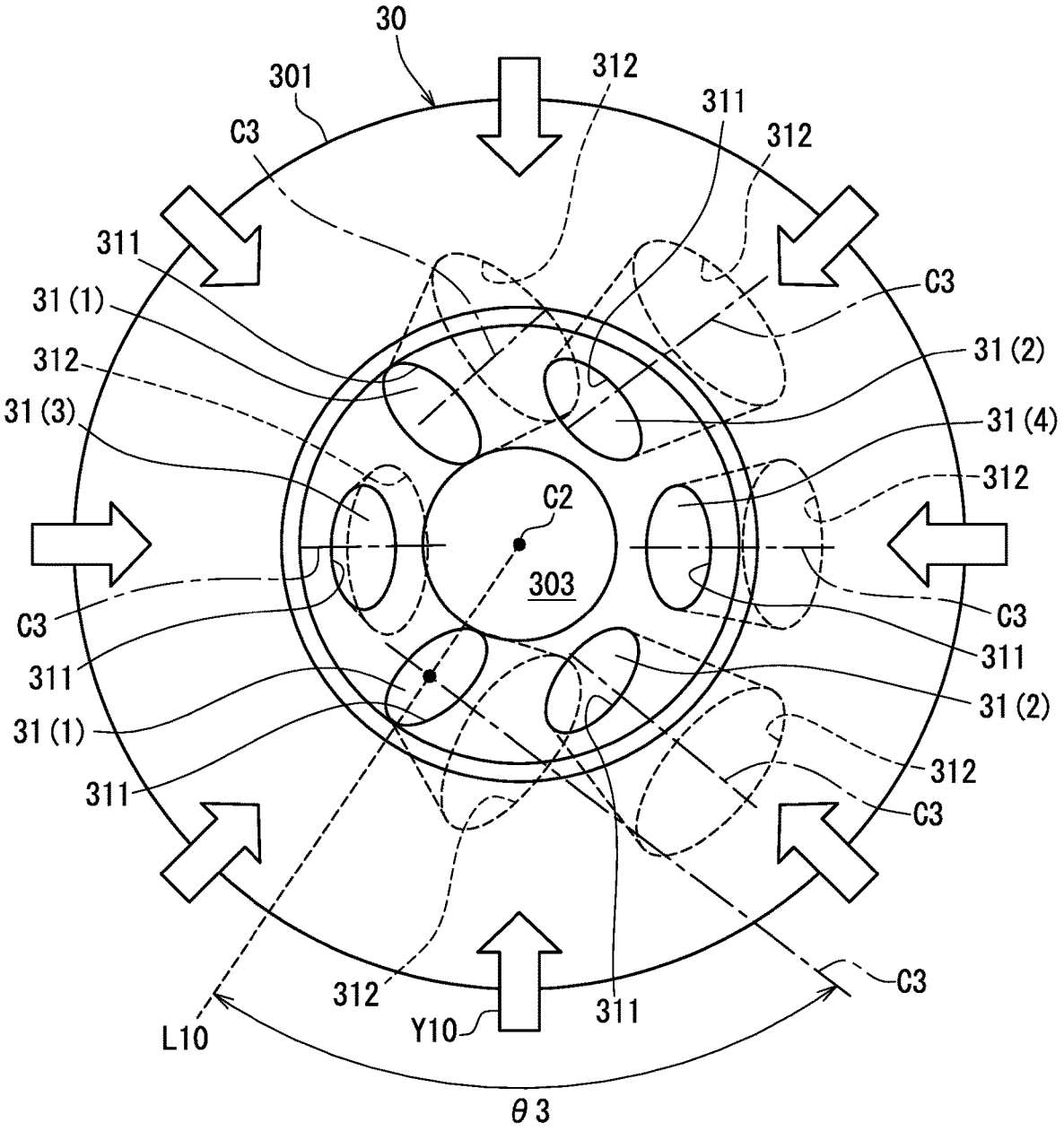
FIG. 28 is a top view showing the injection nozzle according to the fourth embodiment when viewed from the inlet port side.

As shown in FIG. 28, among the lines extending in the radial direction of the injection nozzle 30 through the center line C2, the line passing through the center of gravity of the inlet 311 or the center of the inlet 311 is referred to as an imaginary line L10. The angle between the imaginary line L10 and the injection hole axis C3 when viewed along the direction of the center line C2 is referred to as a twist angle θ3.

In short, the direction of fuel flowing from the annular passage 305 into the distribution passage 303 and flowing toward the inlets 311 (see arrow Y10) is parallel to the imaginary line L10. In this way, the direction of the fuel flowing toward the inlets 311 does not coincide with but is twisted with respect to the direction of fuel injection from the outlet 312. The degree of twist is represented by the twist angle θ3.

For example, among the multiple injection holes 31, the twist angle θ3 of the injection hole 31(1) is about 90 degrees, the twist angle θ3 of the injection hole 31(2) is less than 90 degrees (acute angle), the twist angle θ3 of the injection hole 31(3) is 180 degrees (obtuse angle), and the twist angle θ3 of the injection hole 31(4) is zero degree. In other words, the closer the twist angle θ3 is to 90 degrees, the greater the degree of twist. That is, among the four types of injection holes 31 shown in FIG. 28, the degree of twist of the injection hole 31(1) is the largest.

Figure 29:
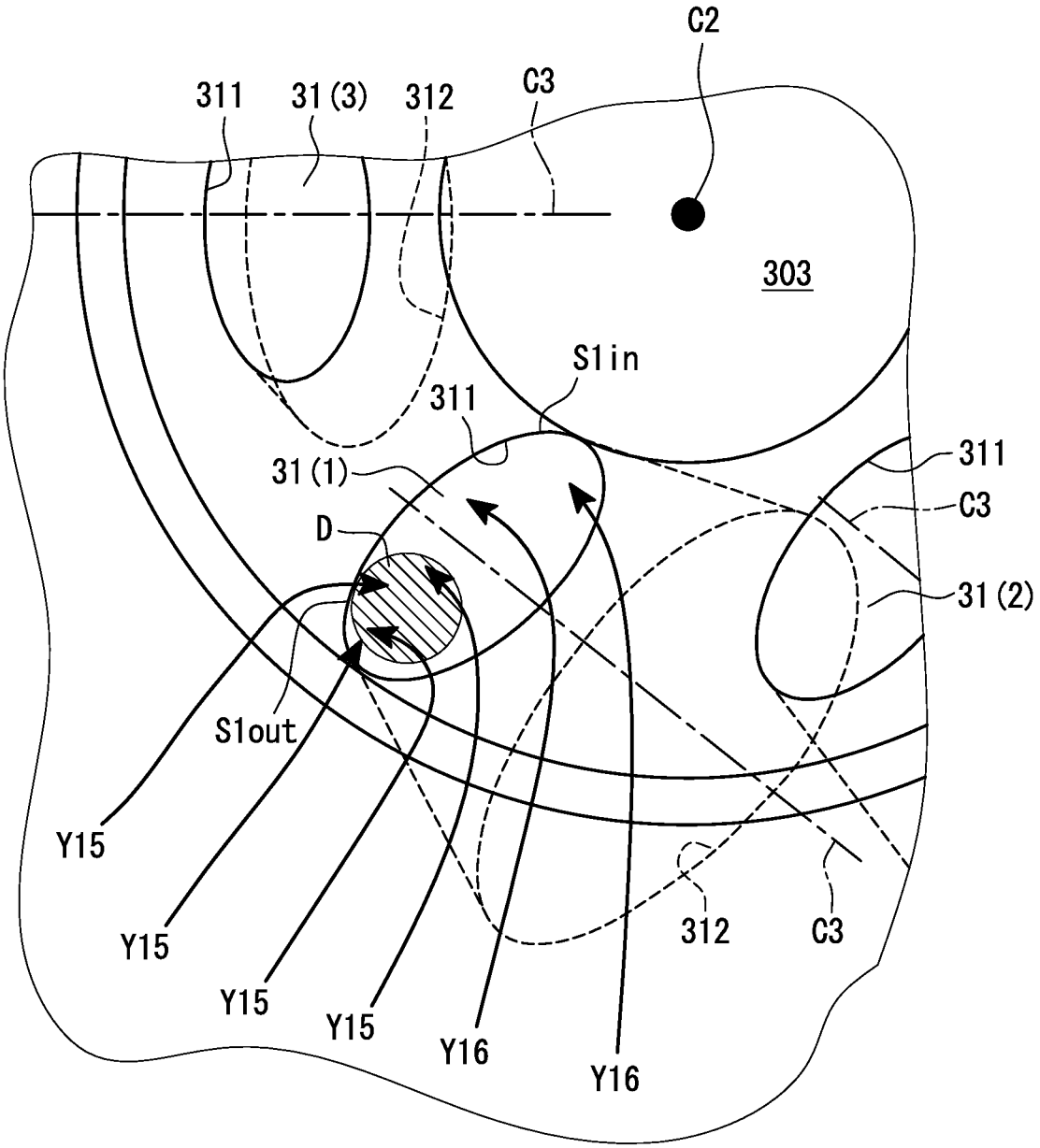
FIG. 29 is an enlarged view of FIG. 28.

As shown in FIG. 29, in the injection hole 31(1) having a large degree of twist, distribution of fuel (see arrow Y10) flowing from the annular passage 305 into the distribution passage 303 and flowing toward the inlet 311 is shown by arrows Y15 and Y16. That is, the flow rate of fuel flowing into the outer semi-ellipse S1*out* (see arrow Y15) is larger than the flow rate of fuel flowing into the inner semi-ellipse S1*in* (see arrow Y16). That is, the inflow flow rate of fuel to the region D shown by the diagonal lines in FIG. 29 increases.

Figure 30:
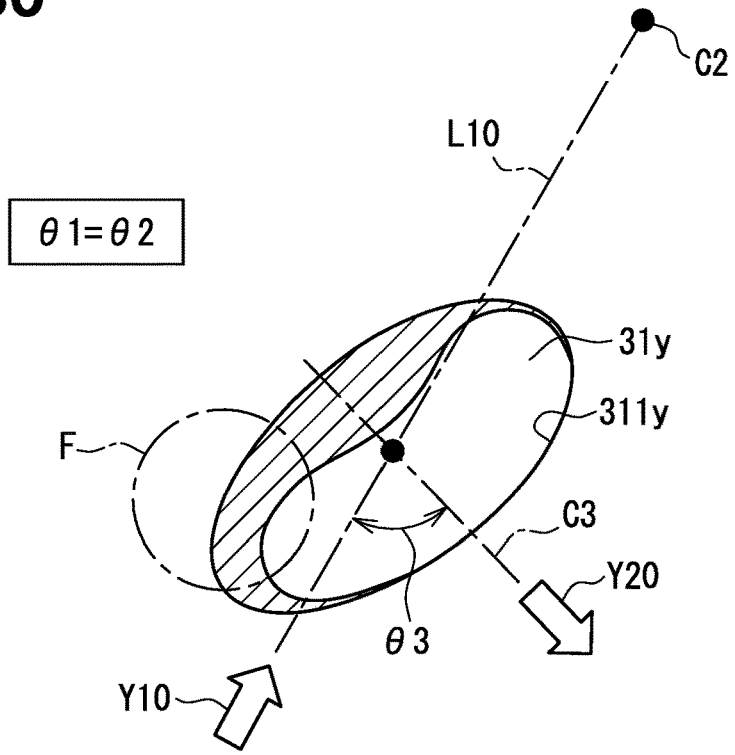
FIG. 30 is a view showing a distribution of fuel at an inlet portion of the injection hole according to the comparative example of the fourth embodiment.

FIG. 30 is a top view showing an injection hole 31*y* according to a comparative example having a shape that is contrary to the shape of the present embodiment as viewed from the side of the inlet 311*y*. The diagonal lines in the drawing indicates the fuel distributed in the injection hole 31*y*. As described above with reference to FIG. 29, the flow rate of fuel flowing into the outer semi-ellipse S1*out* is larger than the flow rate of fuel flowing into the inner semi-ellipse S1*in*. Therefore, the fuel that spreads along the inner wall surface of the injection hole tends to be unevenly distributed in the portion of the outer semi-elliptical S1*out*, and therefore, the liquid film in the region F shown by the alternate long and short dash line tends to become thick.

Figure 31:
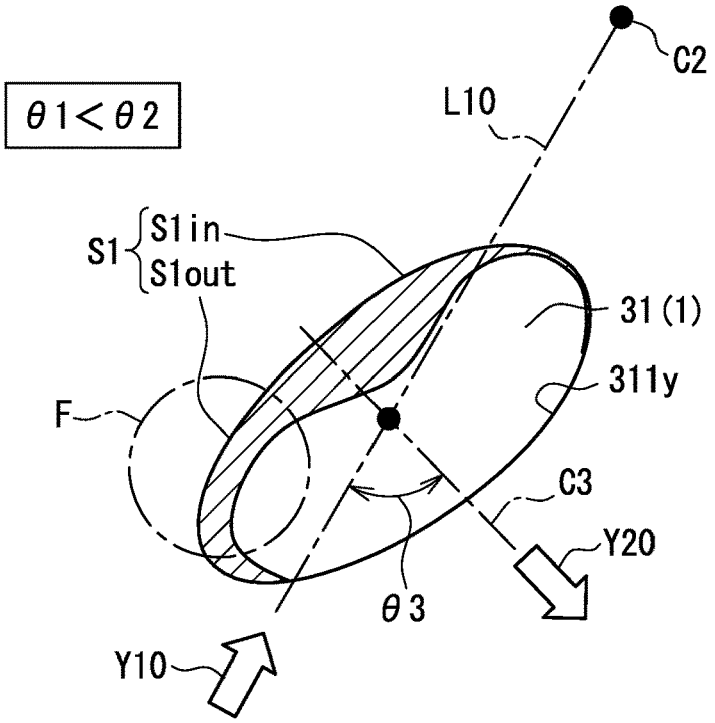
FIG. 31 is a view showing a distribution of fuel at an inlet portion of the injection hole according to the fourth embodiment.

To the contrary, in the present embodiment shown in FIG. 31, the long axis Lbout of the outer semi-ellipse S1*out* is longer than the long axis Lbin of the inner semi-ellipse S1*in*. Therefore, the configuration promotes the fuel in the region F shown by the alternate long and short dash line to spread along the wall surface, thereby to enable to suppress the thickening of the liquid film. In addition, the inner taper angle θ1 is set to a value smaller than the outer taper angle θ2. Therefore, the configuration promotes the fuel in the region F shown by the alternate long and short dash line to spread along the wall surface, thereby to enable to suppress the thickening of the liquid film.

As described above, according to the present embodiment, the configuration enables to promote the thinning of the liquid film in the injection hole 31, thereby to enable to further atomize the fuel (spray) injected from the outlet 312 and to reduce the penetration of the fuel (spray).

Similarly to the first embodiment, according to the present embodiment, the shape of the injection hole perpendicular cross sections is the similar shape, regardless of the position on the injection hole axis C3 at which the cross section resides, and the short axis La/long axis Lb ratio does not change. The configuration enables to produce similar advantages to those of the first embodiment.

Other Embodiments

Although the multiple embodiments of the present disclosure have been described above, not only the combinations of the configurations explicitly shown in the description of each embodiment, but also the configurations of multiple embodiments may be partially combined even if those are not explicitly shown unless a problem arises in the combination in particular. Unspecified combinations of the configurations described in the plurality of embodiments and the modification examples are also disclosed in the following description.

In the first embodiment, the injection hole perpendicular cross section has the elliptical shape. It is noted that the injection hole perpendicular cross section need not have the elliptical shape as long as the injection hole perpendicular cross section has a flat shape.

The injection hole longitudinal cross section according to the first embodiment has the tapered shape in which the inner wall surface of the injection hole 31 linearly expands from the inlet 311 to the outlet 312. To the contrary, the injection hole longitudinal cross section may have a curved shape such that the inner wall surface is curvedly enlarged from the inlet 311 to the outlet 312.

In the first embodiment, when the injection hole 31 is laser-machined, the laser beam is emitted from the side of the outlet 312 toward the side of the inlet 311. To the contrary, the laser machining may be performed by emitting the laser light from the side of the inlet 311 toward the side of the outlet 312.

In the first embodiment, the number of the injection holes 31 is 6. It is noted that number of the injection holes 31 may be a plural number other than 6 or may be 1.

In the fourth embodiment, on assumption that the injection hole perpendicular cross sections have the similar shape and that the short axis La/long axis Lb ratio does not change, the long axis Lbout of the outer semi-ellipse S1*out* and S2*out* is longer than the long axis Lbin of the inner semi-ellipse S1*in* and S2*in*. To the contrary, in a case where the long axis Lbout of the outer semi-ellipse S1*out* and S2*out* is set to be longer than the long axis Lbin of the inner semi-ellipse S1*in* and S2*in*, the injection hole perpendicular cross sections may have non-similar shapes or may have shapes such that the short axis La/long axis Lb ratio may change.

In the fourth embodiment, the inner taper angle θ1 is smaller than the outer taper angle θ2 on the premise that the injection hole perpendicular cross section has the similar shapes and that the ratio of the short axis La/long axis Lb does not change. To the contrary, in a case where the inner taper angle θ1 is set to be smaller than the outer taper angle θ2, the perpendicular cross section of the injection hole may have a non-similar shape, or the short axis La/long axis Lb ratio may change.

While the present disclosure has been described with reference to the embodiments thereof, it is to be understood that the disclosure is not limited to the embodiments and constructions. The present disclosure encompasses various modifications and variations within the scope of equivalents. In addition, while the various combinations and configurations, which are preferred, other combinations and configurations, including more, less or only a single element, are also within the spirit and scope of the present disclosure.

What is claim is:

1. A fuel injection valve, comprising:

a nozzle body having an injection hole, configured for fuel injection, and a fuel passage connecting to the injection hole; and a needle configured to open and close the fuel passage to switch between fuel injection from the injection hole and stopping the fuel injection, wherein an injection hole axis extends along a center of the injection hole, an injection hole perpendicular cross section is a cross section of the injection hole perpendicular to the injection hole axis, the injection hole perpendicular cross section has a flat shape, the injection hole perpendicular cross section has an area gradually expanding from an inlet of the injection hole to an outlet of the injection hole while maintaining a similar shape, the inlet is formed in a curved surface, the outlet is formed in a flat surface, the inlet has an outer end and an inner end with respect to a radial direction of a center line of the nozzle body, the outlet has an outer end and an inner end with respect to the radial direction of the center line of the nozzle body, and the inlet and the outlet are inclined relative to each other, such that a linear distance between the outer end of the inlet and the outer end of the outlet is smaller than a linear distance between the inner end of the inlet and the inner end of the outlet.

2. The fuel injection valve according to claim 1, wherein an injection hole longitudinal cross section is a cross section of the injection hole including the injection hole axis, and the injection hole longitudinal cross section has a tapered shape in which an inner wall surface of the injection hole linearly expands from the inlet to the outlet.

3. A fuel injection valve, comprising:

a nozzle body having an injection hole, configured for fuel injection, and a fuel passage connecting to the injection hole; and a needle configured to open and close the fuel passage to switch between fuel injection from the injection hole and stopping the fuel injection, wherein an injection hole axis extends along a center of the injection hole, an injection hole perpendicular cross section is a cross section of the injection hole perpendicular to the injection hole axis, the injection hole perpendicular cross section has a shape in which an area gradually expands from an inlet of the injection hole to an outlet of the injection hole while maintaining an elliptical shape having a short axis and a long axis, the injection hole has a shape in which a ratio of a length of the short axis to a length of the long axis is constant from the inlet to the outlet, the inlet is formed in a curved surface, the outlet is formed in a flat surface, the inlet has an outer end and an inner end with respect to a radial direction of a center line of the nozzle body, the outlet has an outer end and an inner end with respect to the radial direction of the center line of the nozzle body, and the inlet and the outlet are inclined relative to each other, such that a linear distance between the outer end of the inlet and the outer end of the outlet is smaller than a linear distance between the inner end of the inlet and the inner end of the outlet.

4. The fuel injection valve according to claim 3, wherein an injection hole longitudinal cross section is a cross section of the injection hole including the injection hole axis, a short axis plane is of the injection hole longitudinal cross section and is a plane including the short axis, a long axis plane is of the injection hole longitudinal cross section and is a plane including the long axis, the injection hole longitudinal cross section has a tapered shape in which an inner wall surface of the injection hole linearly expands from the inlet to the outlet, and a ratio of a short axis taper angle, which is a taper angle of a tapered shape of the short axis plane, to a long axis taper angle, which is a taper angle of a tapered shape of the long axis plane, is same as the ratio of the length of the short axis to the length of the long axis.

5. The fuel injection valve according to claim 1, wherein the injection hole includes a plurality of the injection holes formed in the nozzle body, the plurality of injection holes have inlets, respectively, arranged around the center line of the nozzle body, and the fuel passage includes:

an annular passage that has an annular form and extends around the center line to conduct fuel in a direction in which the center line extends and a distribution passage configured to collect the fuel that has passed through the annular passage and to distribute the fuel to the inlets.

6. The fuel injection valve according to claim 5, wherein the injection hole perpendicular cross section is a combination of two semi-ellipses that are different in length of a long axis while sharing the short axis throughout from the inlet to the outlet, the two semi-ellipses include an inner semi-ellipse, which is a semi-ellipse closer to the center line, and an outer semi-ellipse, which is a semi-ellipse on a first side, and the injection hole has a shape in which the long axis of the outer semi-ellipse is longer than the long axis of the inner semi-ellipse.

7. The fuel injection valve according to claim 5, wherein the injection hole perpendicular cross section has a shape in which an area gradually expands from the inlet to the outlet while maintaining an elliptical shape having a short axis and a long axis, an injection hole longitudinal cross section is a cross section of the injection hole including the injection hole axis, a short axis plane is of the injection hole longitudinal cross section and is a plane including the short axis, a long axis plane is of the injection hole longitudinal cross section and is a plane including the long axis, a wall surface of the injection hole in the long axis plane includes an inner wall surface that is a wall surface closer to the center line, a wall surface of the injection hole in the long axis plane includes an outer wall surface that is a wall surface farther from the center line, and an inner taper angle, which is an angle between the inner wall surface and the injection hole axis, is smaller than an outer taper angle, which is an angle between the outer wall surface and the injection hole axis.

8. The fuel injection valve according to claim 1, wherein inlets of the plurality of injection holes are arranged in a concentric form around the center line of the nozzle body.

9. The fuel injection valve according to claim 1, wherein the nozzle body has an injection portion that has a hollow hemispherical shape, the injection portion has an inner surface having the curved surface defining the inlet, the nozzle body has an outer surface having a recess recessed toward the inlet, and the recess has the flat surface defining the outlet.

10. The fuel injection valve according to claim 1, wherein a first intersection distance is a distance from a point, at which inner wall surfaces of the injection hole appearing in a short axis cross section are extended and intersect to each other, to the injection hole perpendicular cross section in the outlet, a second intersection distance is a distance from a point, at which inner wall surfaces of the injection hole appearing in a long axis cross section are extended and intersect to each other, to the injection hole perpendicular cross section in the outlet, and the first intersection distance and the second intersection distance are equal to each other.

11. The fuel injection valve according to claim 10, wherein the flat shape is formed of elliptical arcs.

12. The fuel injection valve according to claim 3, wherein a first intersection distance is a distance from a point, at which inner wall surfaces of the injection hole appearing in a short axis cross section are extended and intersect to each other, to the injection hole perpendicular cross section in the outlet, a second intersection distance is a distance from a point, at which inner wall surfaces of the injection hole appearing in a long axis cross section are extended and intersect to each other, to the injection hole perpendicular cross section in the outlet, and the first intersection distance and the second intersection distance are equal to each other.

13. The fuel injection valve according to claim 12, wherein the flat shape is formed of elliptical arcs.

14. The fuel injection valve according to claim 1, wherein the injection hole perpendicular cross section has the flat shape at any position in a direction of the injection hole axis.

15. The fuel injection valve according to claim 1, wherein the similar shape has a first axis and a second axis, and a ratio of length of the short axis to length of the long axis is constant at any position in a direction of the injection hole axis.

16. The fuel injection valve according to claim 1, wherein the similar shape has a first axis and a second axis, and a ratio of length of the short axis to length of the long axis remains unchanged from the inlet to the outlet.

17. The fuel injection valve according to claim 1, wherein the outlet of the injection hole is located at a position recessed toward the inlet of the injection hole relative to an outer surface of an injection portion.

18. The fuel injection valve according to claim 1, wherein a recess is formed on an outer surface of an injection portion, and the injection hole is formed in the recess.

19. The fuel injection valve according to claim 18, wherein the recess includes a tubular shape formed coaxially with an injection hole axis of the injection hole.

20. The fuel injection valve according to claim 1, wherein an injection hole longitudinal cross section is a cross section of the injection hole including the injection hole axis, a short axis plane is of the injection hole longitudinal cross section and is a plane including a short axis, a long axis plane is of the injection hole longitudinal cross section and is a plane including a long axis, the injection hole longitudinal cross section has a tapered shape in which an inner wall surface of the injection hole linearly expands from the inlet to the outlet, and a ratio of a short axis taper angle, which is a taper angle of a tapered shape of the short axis plane, to a long axis taper angle, which is a taper angle of a tapered shape of the long axis plane, is same as a ratio of a length of the short axis to a length of the long axis.

* * * * *